US011174608B1

(12) United States Patent
Sullivan

(10) Patent No.: US 11,174,608 B1
(45) Date of Patent: Nov. 16, 2021

(54) POWER-ASSISTED SKI TRACK SETTER SYSTEM

(71) Applicant: Mary Margaret Sullivan, Spokane, WA (US)

(72) Inventor: Mary Margaret Sullivan, Spokane, WA (US)

( * ) Notice: Subject to any disclaimer, the term of this patent is extended or adjusted under 35 U.S.C. 154(b) by 0 days.

(21) Appl. No.: 17/221,696

(22) Filed: Apr. 2, 2021

(51) Int. Cl.
*E01H 4/02* (2006.01)

(52) U.S. Cl.
CPC ..... *E01H 4/02* (2013.01)

(58) Field of Classification Search
CPC .. E01H 4/00; E01H 4/02; E01H 4/023; E01H 2004/026
See application file for complete search history.

(56) References Cited

U.S. PATENT DOCUMENTS 2,345,496 A * 3/1944 Opheim ..... B61B 11/002 180/9.22
2,393,309 A * 1/1946 Cochran ..... B62D 51/007 180/9.22
2,519,745 A * 8/1950 Danielson ..... B62D 51/007 180/9.22
2,855,059 A * 10/1958 Sidneys ..... B62M 27/02 180/9.62
3,405,777 A * 10/1968 Von Kemenczky ... B62M 27/02 180/7.2
3,789,941 A * 2/1974 Robertson ..... B62D 51/007 180/9.22
3,826,323 A * 7/1974 Mehne ..... A63C 5/085 180/180
4,102,292 A * 7/1978 Hunter ..... B60F 3/0007 180/6.5
4,202,118 A * 5/1980 Held ..... B62M 27/02 172/817
4,519,470 A * 5/1985 Allisio ..... A63C 5/08 180/180
5,224,552 A * 7/1993 Lee ..... A01B 33/028 172/113
6,085,686 A * 7/2000 Hemmingson ..... B63B 34/60 114/343
6,193,003 B1 * 2/2001 Dempster ..... A63C 11/10 180/180
6,508,746 B1 * 1/2003 Jacobs ..... A63B 21/023 482/51
6,513,267 B2 * 2/2003 Yoshida ..... E01H 5/04 37/283
6,725,959 B1 * 4/2004 Shea ..... B62K 3/002 180/190

(Continued)

*Primary Examiner* — Jessica H Lutz
(74) *Attorney, Agent, or Firm* — Perkins Coie LLP

(57) ABSTRACT

A power-assisted ski track setter including a user control assembly, a track cutter assembly, and a drive assembly configured to operably engage the track cutter assembly is provided. The user control assembly is configured to control the direction of the power-assisted ski track setter. The track cutter assembly comprises a frame, a set of wheels operably coupled to the frame, a set of axles operably coupled to the wheels, and a set of tracks encircling the set of wheels. The set of wheels rotatably supports the frame. The drive assembly is configured to be mounted adjacent to the frame. The drive assembly comprises a motor configured to transmit power to the track cutter assembly, a battery electrically connected to the motor, and a drive gear operably coupled to the motor.

19 Claims, 25 Drawing Sheets

(56) References Cited

U.S. PATENT DOCUMENTS

| | | | | |
|---|---|---|---|---|
| 7,182,165 | B1 * | 2/2007 | Keinath | B62M 27/02 180/185 |
| 7,434,644 | B2 * | 10/2008 | Wier | A63C 5/03 180/172 |
| 8,827,014 | B2 * | 9/2014 | Martel | B62D 51/007 180/9.22 |
| 9,694,859 | B2 * | 7/2017 | Martel | H01M 10/625 |
| 9,873,485 | B2 * | 1/2018 | Mangum | B62K 13/08 |
| 10,065,708 | B2 * | 9/2018 | Labbe | B62M 27/02 |
| 10,479,448 | B2 * | 11/2019 | Tapio | B62D 55/088 |
| 10,597,117 | B2 * | 3/2020 | LeBlanc | B62M 27/02 |
| 2008/0023233 | A1 * | 1/2008 | Westergaard | B62D 51/007 180/9.1 |
| 2011/0011652 | A1 * | 1/2011 | Swenson | B62D 55/075 180/9.23 |
| 2011/0163588 | A1 * | 7/2011 | Burt | B62D 51/04 298/17 R |
| 2012/0161511 | A1 * | 6/2012 | Brazier | B62D 55/14 305/178 |
| 2014/0202046 | A1 * | 7/2014 | Yamazaki | B60K 20/08 37/249 |
| 2015/0107136 | A1 * | 4/2015 | Fukano | E01H 5/098 37/235 |

* cited by examiner

POWER-ASSISTED SKI TRACK SETTER SYSTEM

TECHNICAL FIELD

The present technology is related to a mechanical device to set ski tracks in snow, and more particularly, to ski track setting devices that are assisted by a battery-powered assembly.

BACKGROUND

Setting ski tracks in snow using conventional trail groomers typically involves towing a track setting device behind a vehicle, such as a tractor, an ATV, or a snowmobile. The track setting device (e.g., ski track setter) is designed to create new tracks in the snow and/or to level and smooth old tracks that have been degraded, such as by repeated use and environmental factors including wind and temperature fluctuations. Such ski track setters are typically very expensive for personal use, and are generally only used to groom snow located on public parklands and/or at resorts.

For personal use such as for grooming snow on forest trails, rural roads, and private rural properties, a user may use a self-assembled ski track setter that does not involve assistance from a vehicle (e.g., tractor, ATV, or snowmobile). The user may self-assemble the ski track setter from two slats of wood and use stones, bricks, etc., to weigh down the wood slats during operation. In operation, the user pulls the ski track setter by means of a rope or harness while the user walks or skis in front of the ski track setter. Operating such self-assembled ski track setters to groom the snow, however, can be labor-intensive and slow.

BRIEF DESCRIPTION OF THE DRAWINGS

Many aspects of the present technology can be better understood with reference to the following drawings. The components in the drawings are not necessarily to scale. Instead, emphasis is placed on clearly illustrating the principles of the present technology.

DETAILED DESCRIPTION

The present technology is directed generally to power-assisted ski track setters. Embodiments of the power-assisted ski track setters disclosed herein include a user control assembly, a drive assembly, and a track cutter assembly. The track cutter assembly is configured to receive power from the drive assembly during operation to groom and set ski tracks in the snow. A user can control the speed and/or direction of the power-assisted ski track setter via the user control assembly while the drive assembly provides power to propel the track cutter assembly forward. In operation, the user can be on skis behind the power-assisted ski track setter and activate the power-assisted ski track setter via a throttle controller of the user control assembly. The power-assisted ski track setter may pull the user forward while the user controls the direction of the power-assisted ski track setter via a handlebar of the user control assembly. The power-assisted ski track setters disclosed herein are expected to provide a low-cost and highly efficient device for setting ski tracks without the use of an additional/separate vehicle (e.g., tractor, ATV, or snowmobile), while significantly minimizing the labor needed to set such tracks.

Certain details are set forth in the following description and in FIGS. 1A-8 to provide a thorough understanding of various embodiments of the present technology. In other instances, well-known structures, systems, materials, and/or operations often associated with ski track setters, power-assisted systems, and associated components, electric motors, electric battery systems, etc., are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth. The terminology used below is to be interpreted in its broadest reasonable manner, even though it is being used in conjunction with a detailed description of certain examples of embodiments of the technology. Indeed, certain terms may even be emphasized below; however, any terminology intended to be interpreted in any restricted manner will be overtly and specifically defined as such in this Detailed Description section.

Embodiments of Power-Assisted Ski Track Setters

Figure 1A:
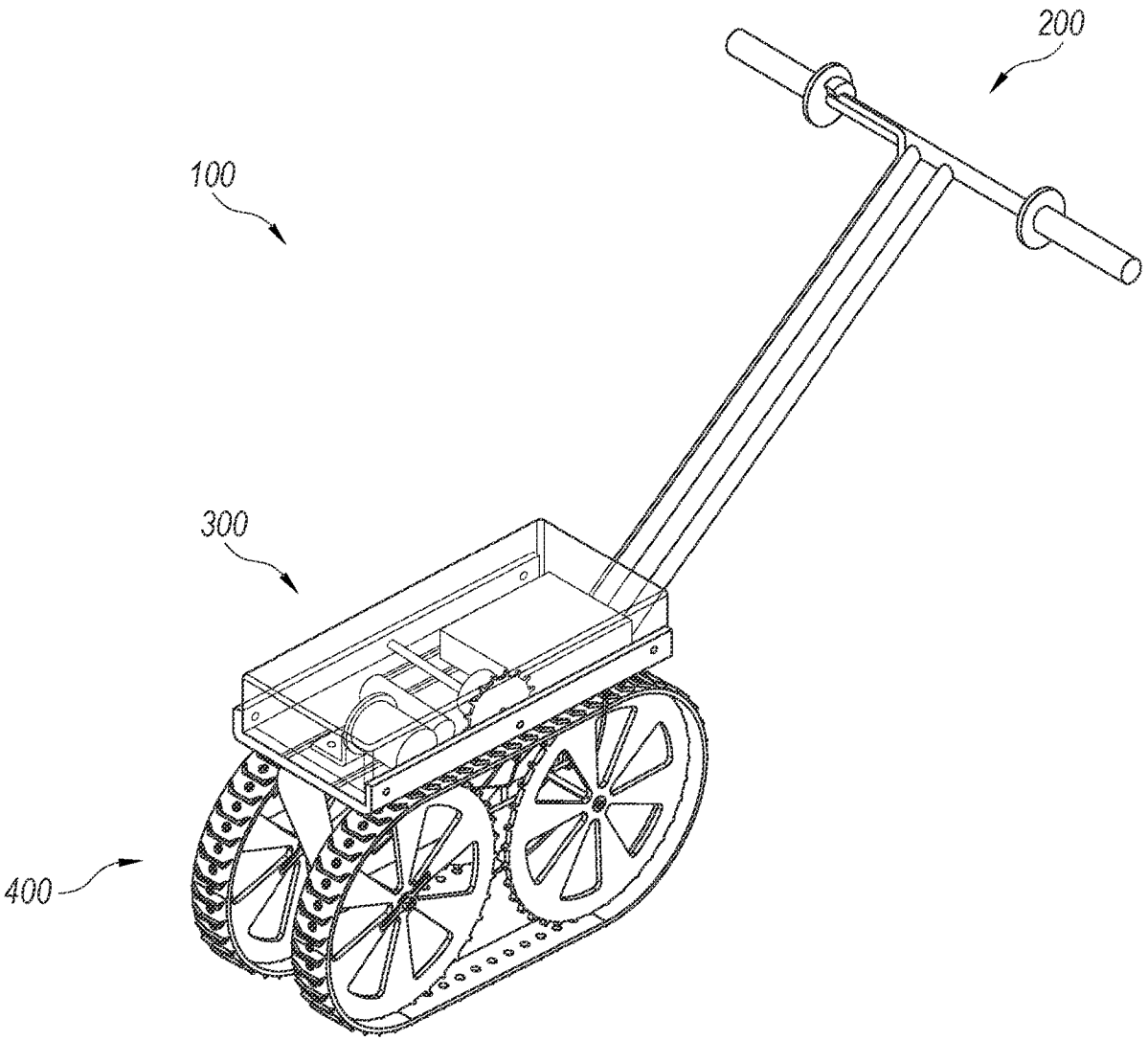
FIG. 1A is a top front left isometric view of a power-assisted ski track setter configured in accordance with embodiments of the present technology.
Figure 1B:
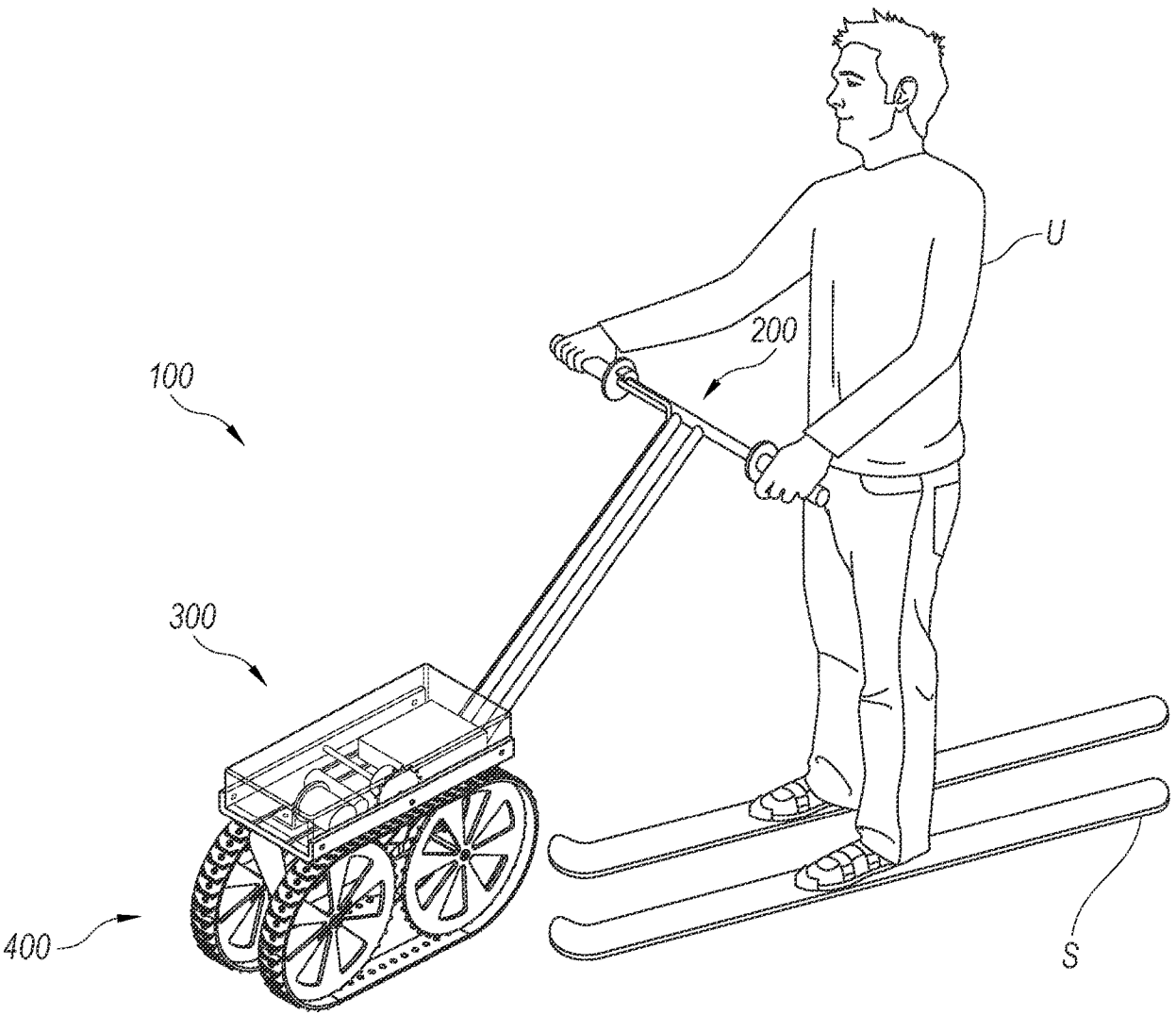
FIG. 1B is a top front left isometric view of the power-assisted ski track setter of FIG. 1A operated by a user.
Figure 1C:
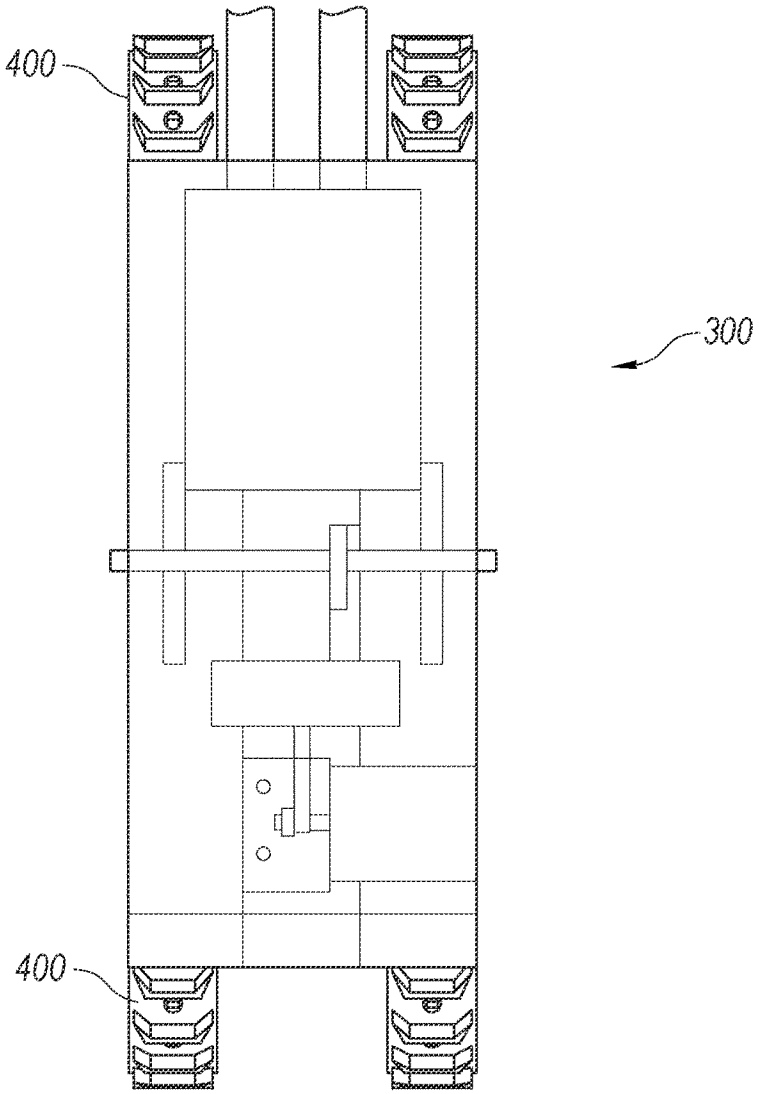
FIG. 1C is a top view of the power-assisted ski track setter of FIG. 1A.
Figure 1D:
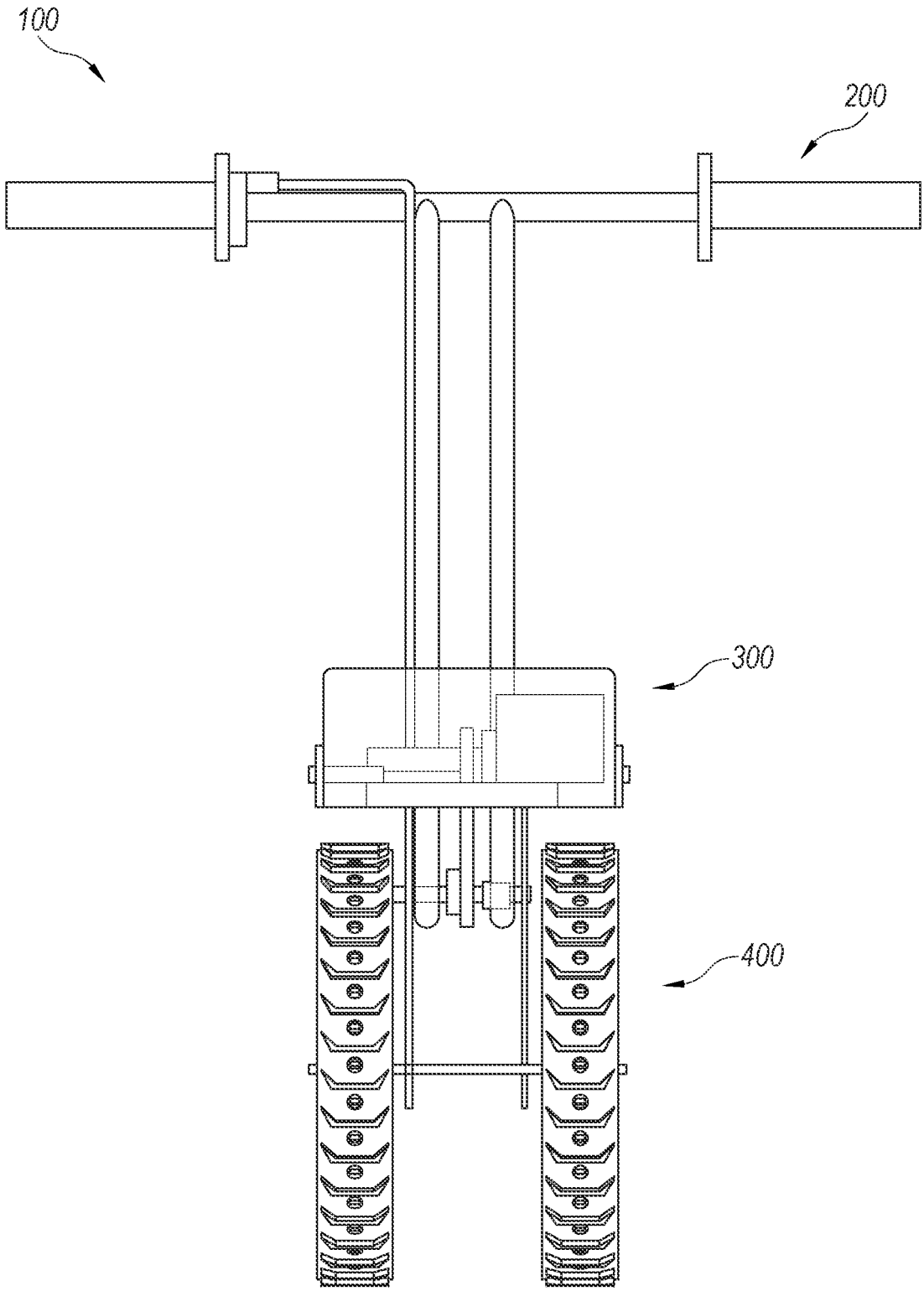
FIG. 1D is a front view of the power-assisted ski track setter of FIG. 1A.
Figure 1E:
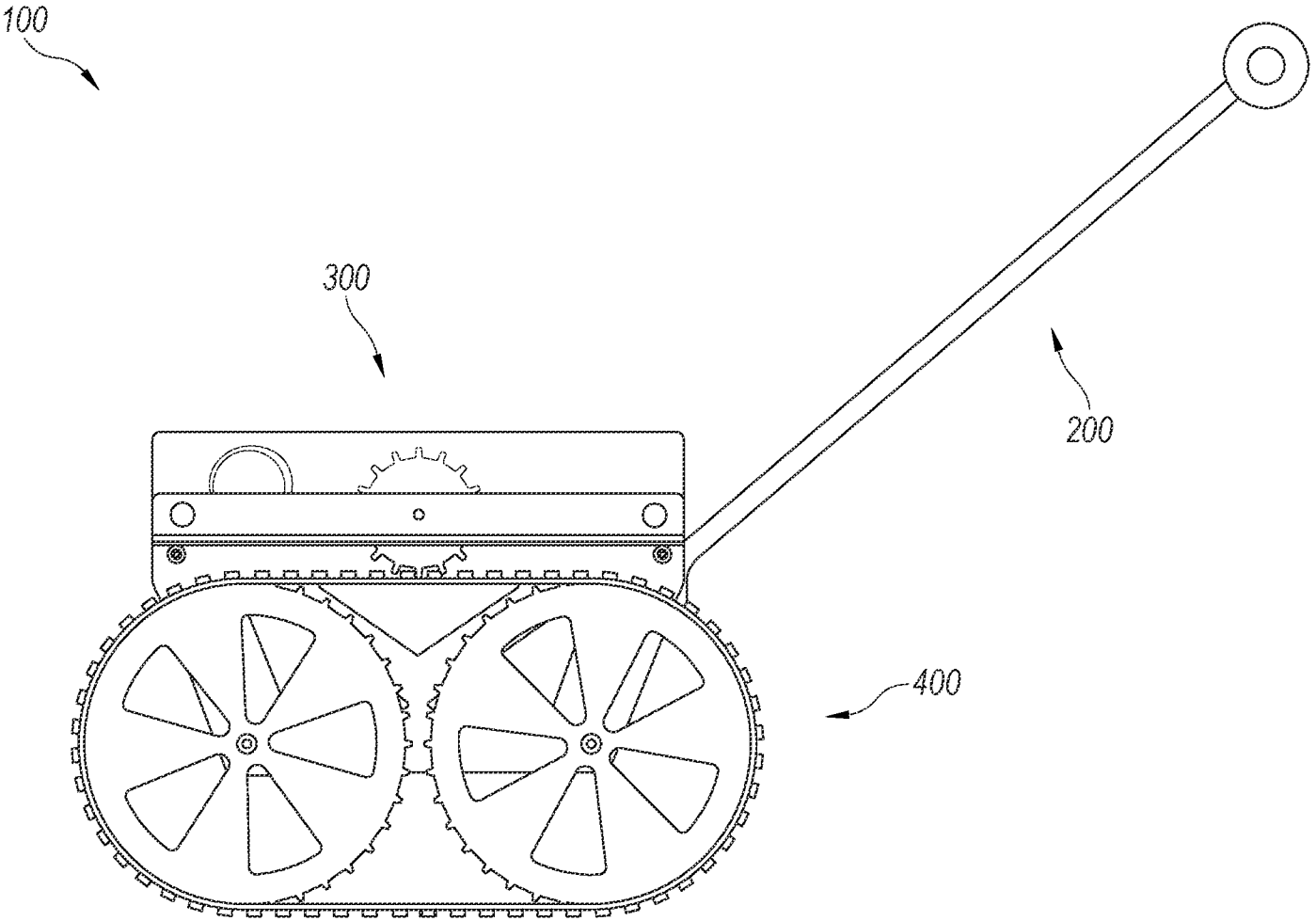
FIG. 1E is a left side view of the power-assisted ski track setter of FIG. 1A.

FIG. 1A is a top front left isometric view of a power-assisted ski track setter ("ski track setter 100") configured in accordance with embodiments of the present technology. FIG. 1B is a top front left isometric view of the ski track setter 100 operated by a user. FIG. 1C is a top view, FIG. 1D is a front view, and FIG. 1E is a left side view of the ski track setter 100. Referring to FIGS. 1A-E together, the ski track setter 100 includes a user control assembly 200, a drive assembly 300, and a track cutter assembly 400. The user control assembly 200 is configured to receive user control inputs and is operably coupled to the drive assembly 300. The drive assembly 300 is configured to operably engage the track cutter assembly 400. During operation, for example, the drive assembly 300 is configured to transmit power to the track cutter assembly 400 to drive the ski track setter 100.

Referring to FIG. 1B, a user U can operate the ski track setter 100 via the user control assembly 200 and provide input to control the direction of the ski track setter 100 during operation. In some embodiments, for example, the ski track setter 100 is configured to be operated by the user U while the user U is positioned behind the ski track setter 100. As shown in FIG. 1B, for example, the user U is wearing a set of skis S and is positioned to selectively guide the ski track setter 100 during operation to groom and set ski tracks in snow (not shown). In other embodiments, the ski track setter 100 is configured to be operated by the user U with the user U positioned in front of or to the side of the ski track setter 100. In one embodiment, for example, the ski track setter 100 can push the user U forward during operation.

The user control assembly 200 is also configured to receive input (e.g., from the user U) and provide such input to the drive assembly 300 with respect to an amount of power for the drive assembly 300 to transmit to the track cutter assembly 400. For example, the user U can indicate to the user control assembly 200 (e.g., via a throttle—described in greater detail below with reference to FIGS. 2A and 2B) the amount of power to transmit to the track cutter assembly 400. The drive assembly 300 may also assist the user U operating the ski track setter 100 by providing a portion of the power required to propel the ski track setter 100, or may provide enough power to fully propel the ski track setter 100 without user contribution (i.e., without the user pushing or otherwise manually propelling the ski track setter 100). In some embodiments, the drive assembly 300 may provide a portion of the power to propel the user U, or may provide enough power to fully propel the user U.

Referring to FIG. 1E, the drive assembly 300 may be mounted to or integrated into the track cutter assembly 400. The drive assembly 300 is located to interface with the track cutter assembly 400. For example, the drive assembly 300 is located above the track cutter assembly 400. In some embodiments, for example, the drive assembly 300 is attached to the track cutter assembly 400 using a quick-connect/disconnect system, such that the drive assembly 300 can be installed or removed quickly and without the use of tools. In other embodiments, the drive assembly 300 is integrated into the track cutter assembly 400 via fasteners (e.g., screws). In still other embodiments, the drive assembly 300 may have a different configuration/arrangement relative to the track cutter assembly 400.

Figure 2A:
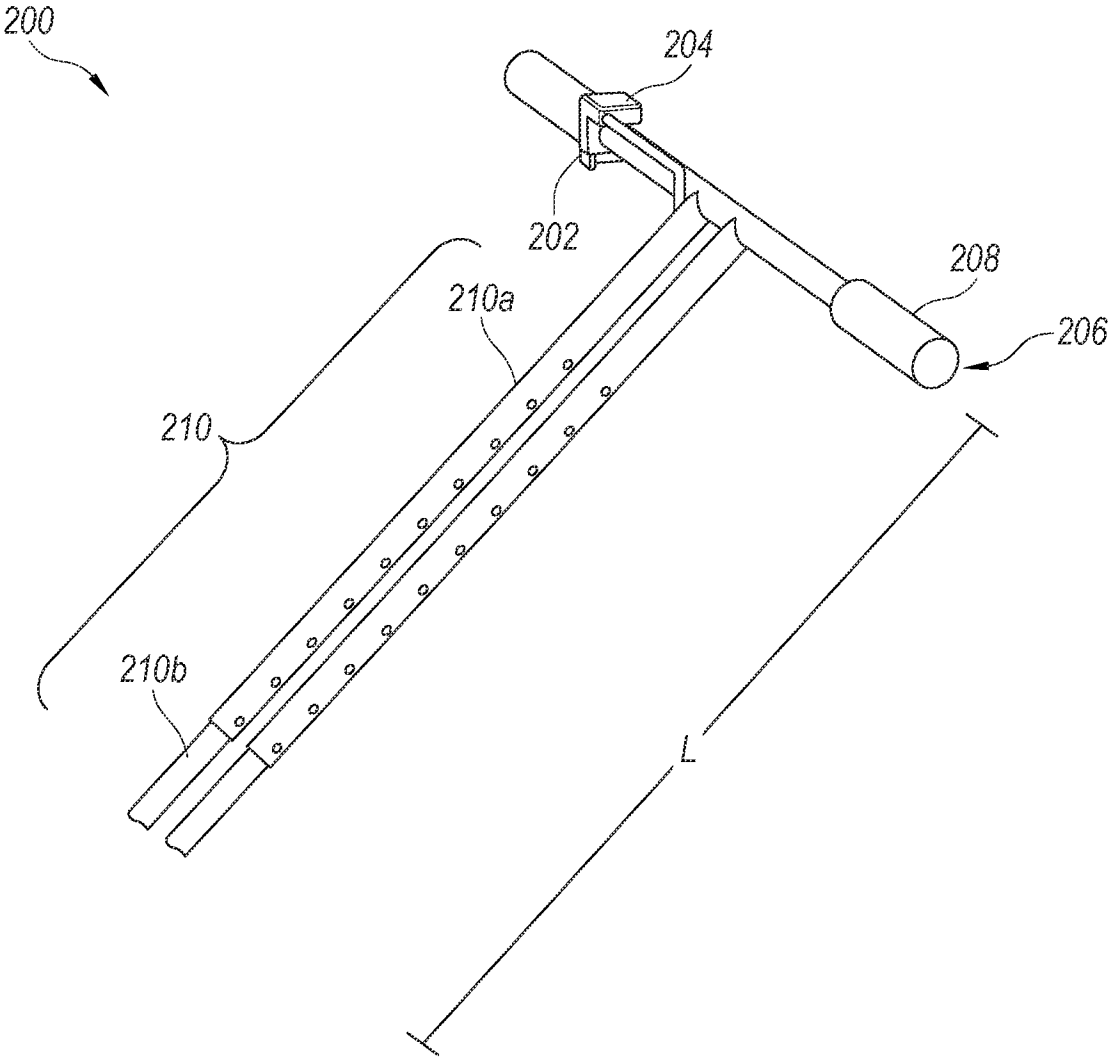
FIG. 2A is a top isometric view of a user control assembly of the power-assisted ski track setter of FIG. 1A.

FIG. 2A is a top isometric view of the user control assembly 200 of the ski track setter 100 (FIG. 1A). For purposes of illustration and clarity, the user control assembly 200 is shown alone without any of the other associated components of the ski track setter 100. Referring to FIG. 2A, the user control assembly 200 includes a throttle controller 202, a power usage display 204, and a handlebar assembly 206. The handlebar assembly 206 includes a handlebar 208 coupled to an elongate adjustment assembly 210. The elongate adjustment assembly 210 can include a first telescoping member 210*a* and a second telescoping member 210*b*. The elongate adjustment assembly 210 is adjustable in length L. The length L can be 2, 3, 4, 5, 6 feet, or any suitable length. For example, the length L can be adjusted to suit the user's height and/or the user's ski length and/or ski stride length. The handlebar 208 and the elongate adjustment assembly 210 may be formed from aluminum, magnesium, or other suitable metal that is cast, machined, forged, etc.

Figure 2B:
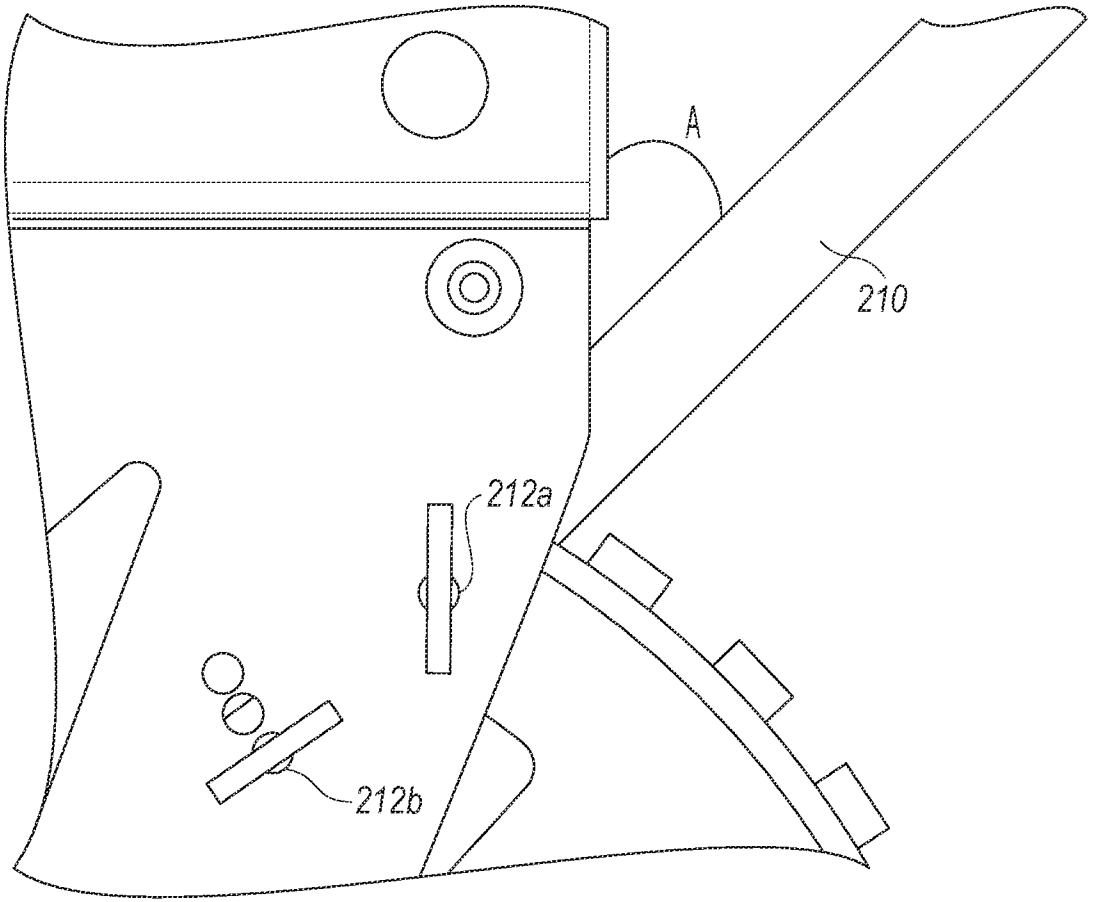
FIG. 2B is an enlarged side view of an angle adjuster of the user control assembly of FIG. 2A.

In some embodiments, the elongate adjustment assembly 210 includes angle adjusters 212*a, b* (FIG. 2B). The angle adjuster 212 is configured to adjust an angle A of the elongate adjustment assembly 210 relative to the drive assembly 300 and the track cutter assembly 400 of the ski track setter 100 (FIG. 1A). The angle adjuster 212 allows the user to adjust the angle A of the elongate adjustment assembly 210 to suit the user's preference (e.g., the user's height).

The throttle controller 202 is in electrical communication with the drive assembly 300 (FIGS. 1A and 1B). As described in greater detail below with reference to FIG. 3A, for example, the throttle controller 202 directs electrical power from a battery 306 to a motor 302 of the drive assembly 300 during operation. The throttle controller 202 is configured to receive a signal from the user (e.g., operated by the user). In operation, the user can selectively vary the throttle position to send a signal to the throttle controller 202 communicating how much power-assist is desired. The throttle controller 202 can be a twist type (motorcycle-style control), a lever (snowmobile-style control), a button, a dial, or any other suitable input device for motor speed control. The throttle controller 202 can communicate with the drive assembly 300 via a wired connection or a wireless connection. In some embodiments, for example, the throttle controller 202 communicates with the drive assembly 300 via a wireless connection and further includes a dead man switch (not shown). The drive assembly 300 (FIG. 3A) can be configured to apply a proportional level of power-assist based on the signal received from the user. The power usage display 204 can be configured to display an energy (e.g., battery power) consumption and/or remaining energy. In some embodiments, the power usage display 204 can be configured to display a speed at which the ski track setter 100 is moving. The power usage display 204 is an optional feature that may not be included in some embodiments.

Referring to FIGS. 1B and 2A together, the handlebar assembly 206 is configured to provide rotational power to at least one wheel of the track cutter assembly 400. For example, the user U can control the direction of the ski track setter 100 via the handlebar assembly 206. In some embodiments, the handlebar assembly 206 is configured to provide rotational power to at least one front wheel of the track cutter assembly 400. In some embodiments, the handlebar assembly 206 is configured to provide rotational power to at least one rear wheel of the track cutter assembly 400. In some embodiments, the handlebar assembly 206 is configured to provide rotational power to all front wheels and/or all rear wheels of the track cutter assembly 400.

Figure 3A:
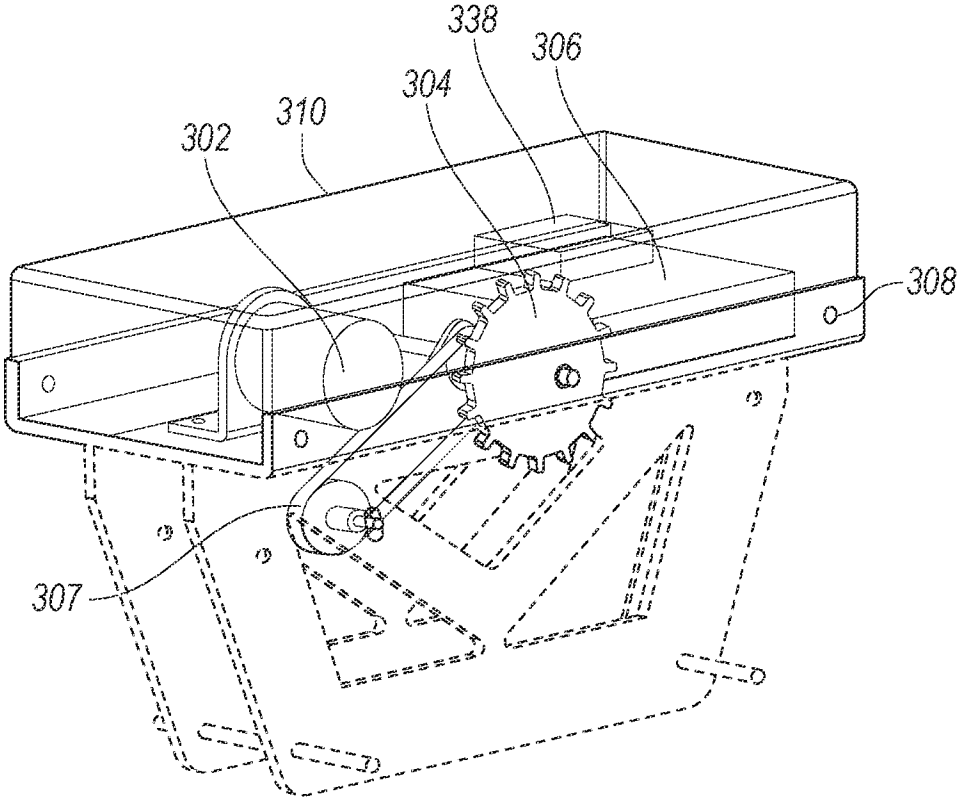
FIG. 3A is a front isometric view of a drive assembly of the power-assisted ski track setter of FIG. 1A.
Figure 3B:
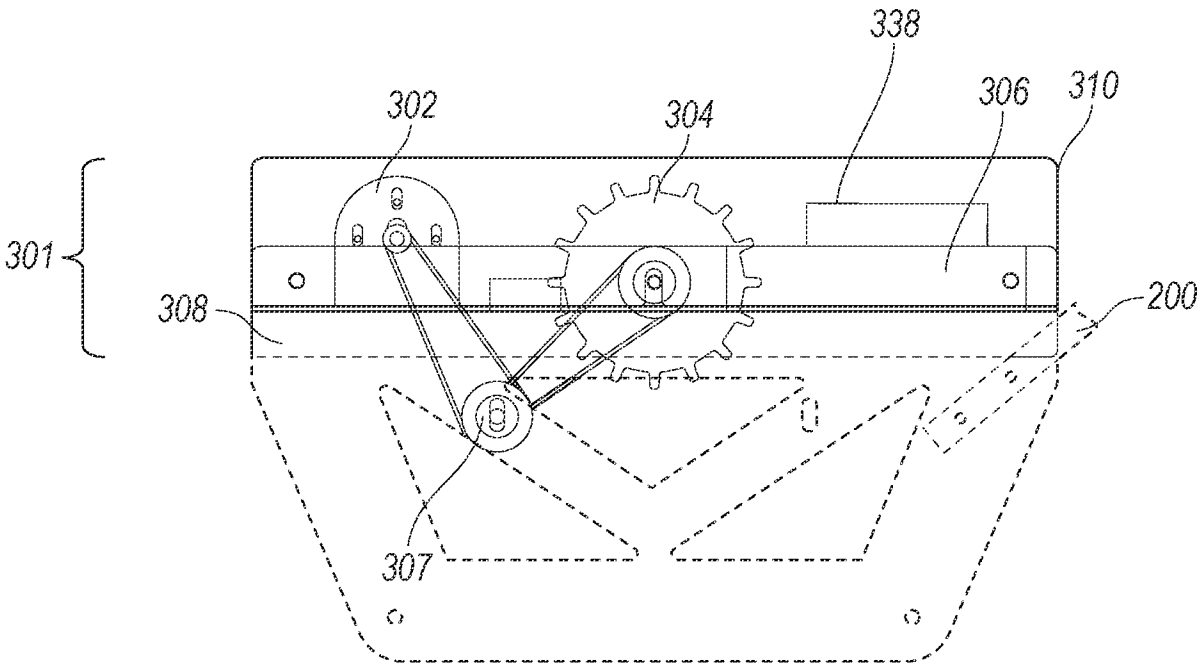
FIG. 3B is a side view of the drive assembly of FIG. 3A.

FIG. 3A is a front isometric view and FIG. 3B is a side view of the drive assembly 300 configured in accordance with embodiments of the present technology. For purposes of illustration and clarity, various structural portions of the drive assembly 300 and track cutter assembly 400 are shown in broken lines. Referring to FIGS. 3A and 3B together, the drive assembly 300 includes a drive unit 301 including the motor 302 configured to transmit power to the track cutter assembly 400, a drive gear 304 operably coupled to the motor 302, the battery 306 in electrical communication with the motor 302, a reduction pulley 307 configured to operably engage the track cutter assembly 400, and an electronic speed controller 338 in electrical communication with the throttle controller 202. The battery 306 can transmit power to the motor 302, which is configured to transfer power to the drive gear 304 to operably engage the reduction pulley 307. In turn, the drive gear 304 operably engaging the reduction pulley 307 rotatably engages the track cutter assembly 400 to drive the ski track setter 100 (FIGS. 1A and 1B) during operation. The reduction pulley 307 can include, but is not limited to, a flat belt pulley, a V belt pulley, a timing pulley, and/or a round belt pulley.

The electronic speed controller 338 is configured to control the speed of the ski track setter 100. For example, the electronic speed controller 338 receives a signal from the throttle controller 202 and, based on the received signal, controls the amount of power transmitted to the motor 302 from the battery 306. In some embodiments, the electronic speed controller 338 can control the amount of voltage supplied to the motor 302 from the battery 306 via a potentiometer or pulse width modulation.

The motor 302 of the drive assembly 300 can include a stepper motor, permanent magnet motor, wheel hub motor, AC induction motor, DC motor, or other suitable type of electric motor. The motor 302 may have power output, for example, in the range of 50 Watts (W) to 2000 W, or greater than 2000 W. In some embodiments, the motor 302 can include aluminum windings and stacked magnets (e.g., a Halbach array). In some embodiments, the motor 302 can have Hall sensors for position sensing and speed control. The motor 302 may be an inrunner-type motor or an outrunner-type motor. In other embodiments, however, the motor 302 can have different features and/or a different configuration.

The drive gear 304 of the drive assembly 300 can include helical gears, spur gears, planetary, hypoid, spiral bevel, face, worm, and/or other suitable gear configurations. The gear type may be selected, for example, based on drive ratio, reduced gear noise, durability, strength, etc. The drive gear 304 can be formed from, for example, nylon, stainless steel, aluminum (e.g., 2024, 7075, etc.), Polyether ether ketone (PEEK), carbon steel, and/or other suitable materials. Depending on the material, the gears can receive various heat treatments and/or include hardened surface coatings (carbon, titanium nitride, anodizing, TEFLON® infusion, etc.), and can be formed by machining, forging, die casting, metal injection molding, etc. In still further embodiments, the drive gear 304 may be composed of different materials and/or have a different arrangement.

The battery 306 of the drive assembly 300 may be lithium-ion (Li-ion), nickel-metal hydride (NiMH), or other suitable battery technologies. In one embodiment, for example, the battery 306 may have an energy capacity in a range from 50 Watt-hours (Wh) to 2000 Wh or greater, and between 20V and 60V by use of a DC/DC converter. In other embodiments, however, the battery 306 may have different features and/or different energy capacities. The battery 306 can include a suitable connection interface to perform powering of peripheral devices, such as charging a mobile phone (with micro USB, USB-C, etc.), powering a computer, light, or other device, etc. Further, in some embodiments, the battery 306 is rechargeable. In some embodiments, the ski track setter 100 includes a wiring harness to provide wire routing to each of the electrical components, and/or can include components configured for wireless communication protocols (e.g., BLUETOOTH®, ANT™, radio-frequency signals, etc.) for low power communications.

In some embodiments, the drive assembly 300 further includes a mounting frame 308 positioned to be coupled to the track cutter assembly 400 (FIG. 1E). In the illustrated embodiments, for example, the drive unit 301 is mounted above the track cutter assembly 400 via the mounting frame 308. In some embodiments, the drive assembly 300 further includes quick-connect couplings (not illustrated) and quick-connect assemblies (not illustrated) securing the drive unit 301 to the mounting frame 308 through the quick-connect couplings. In other embodiments, the drive unit 301 is integrated into the track cutter assembly 400 via the mounting frame 308. For example, the mounting frame 308 of the drive unit 301 can be fixably attached/secured to the track cutter assembly 400 with fasteners (e.g., screws, bolts, etc.), welded, or bonded with an adhesive. The mounting frame 308 may be formed from aluminum, steel, magnesium, other suitable metal, high-strength plastic, or other suitable plastic that is cast, machined, rolled, forged, etc.

In some embodiments, the drive assembly 300 includes a housing 310 configured to mount and cover various components of the drive unit 301. In some embodiments, the housing 310 is configured to receive and support additional components, such as one or more additional batteries. In the illustrated embodiment, the housing 310 (e.g., protective covering) is configured to encase the drive unit 301, including the motor 302, drive gear 304, battery 306, and/or other components of the drive assembly 300. The housing 310 can help reduce the likelihood of damage or wear from contamination ingress, e.g., dirt, water, snow, etc. In other embodiments, the housing 310 can cover only a portion of the drive unit 301.

The housing 310 can be releasably attached to the drive unit 301 with fasteners (e.g., screws, bolts, etc.). In some embodiments, the housing 310 may be formed from aluminum, magnesium, other suitable metal that is cast, machined, forged, stamped, or otherwise formed to shape, polycarbonate (PC), nylon, etc., and may include strengthening material such as fiberglass or carbon fiber.

Figure 4A:
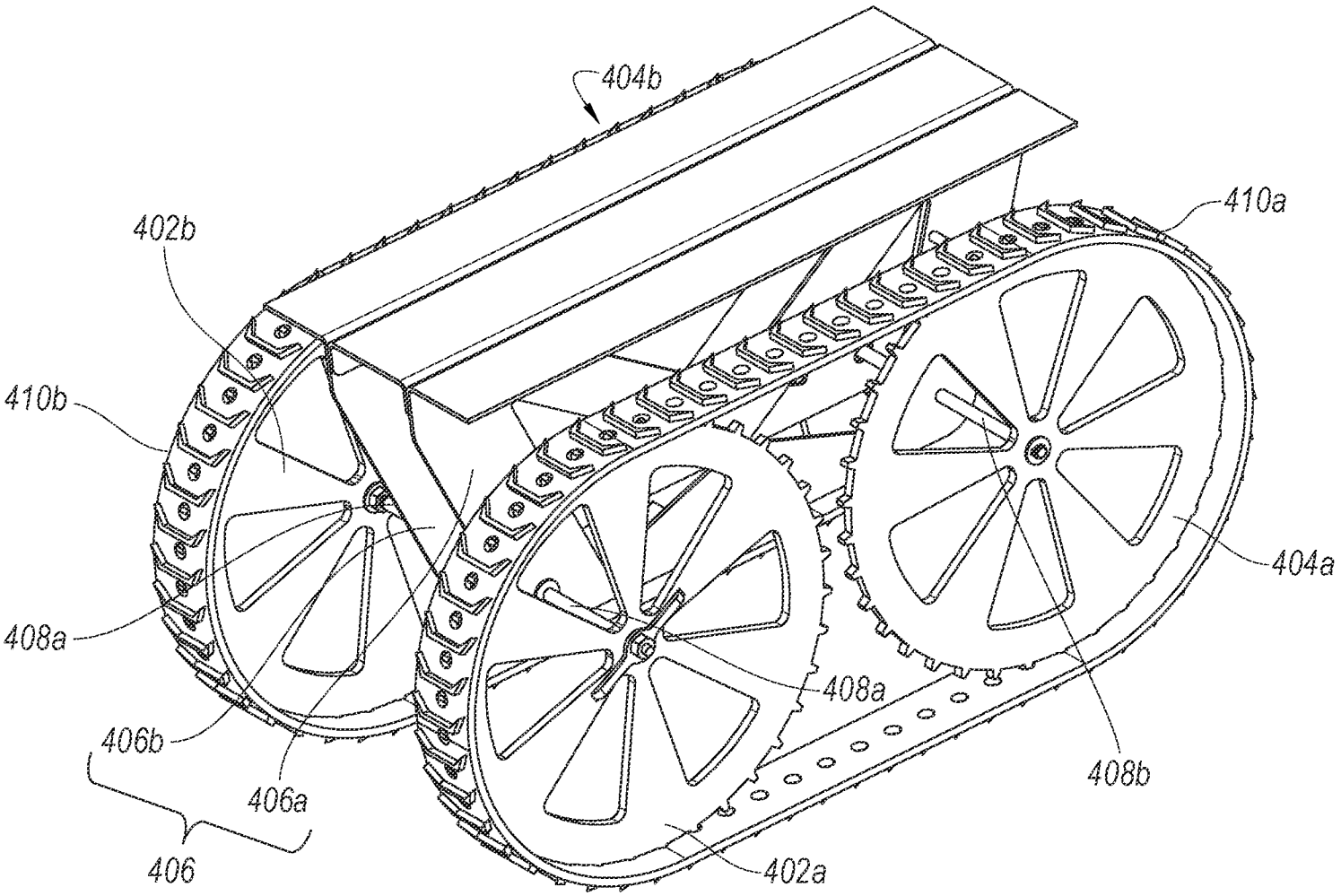
FIG. 4A is a front isometric view of a track cutter assembly of the power-assisted ski track setter of FIG. 1A.

FIG. 4A is a front isometric view of the track cutter assembly 400 configured in accordance with embodiments of the present technology. For purposes of illustration and clarity in FIG. 4A, only the track cutter assembly 400 is shown in FIG. 4A and the other portions of the ski track setter 100 have been omitted. In the illustrated embodiment, the track cutter assembly 400 includes two front wheels 402*a, b* and two rear wheels 404*a, b* coupled to a frame 406 (rear wheel 404*b* is obscured in FIG. 4A). The front wheels 402*a, b* rotatably engage the rear wheels 404*a, b* via tracks 410*a, b*. The track 410*a* encircles the front wheel 402*a* and the rear wheel 404*a*, and the track 410*b* encircles the front wheel 402*b* and the rear wheel 404*b*. The tracks 410*a, b* can be composed of rubber or other suitable track materials. Each wheel 402*a, b* and 404*a, b* can have a diameter, for example, in the range of 8 to 20 inches. In one particular embodiment, for example, each wheel 402*a, b* and 404*a, b* can have a diameter, for example, of 10 inches. In other embodiments, however, the wheels 402*a, b* and 404*a, b* can have other suitable diameters (e.g., less than 8 inches, greater than 20 inches). Each wheel 402*a, b* and 404*a, b* can have a width, for example, of 1, 2, 3, 4, 5, 6 inches, or any suitable width. The frame 406 includes a first frame member 406*a* coupled to a second frame member 406*b* positioned laterally adjacent to the first frame member 406*a*. The front wheel 402*a* and the rear wheel 404*a* are carried by the first frame member 406*a*, and the front wheel 402*b* and the rear wheel 404*b* are carried by the second frame member 406*b*. The distance between the first frame member 406*a* and the second frame member 406*b* can include 2, 4, 6, 8 inches, or any suitable distance. The distance between the front wheels 402*a, b* and the rear wheels 404*a, b* can be 2, 4, 6, 8 inches, or any suitable distance. In some embodiments, the first frame member 406*a* is coupled to the second frame member 406*b* via axles 408*a, b*. In some embodiments, the first frame member 406*a* is attached to the second frame member 406*b* via fasteners (e.g., screws). Although two front wheels 402*a, b* and two rear wheels 404*a, b* are illustrated in FIG. 4A, the track cutter assembly 400 can include any suitable number of wheels on each side of the frame 406.

Figure 4B:
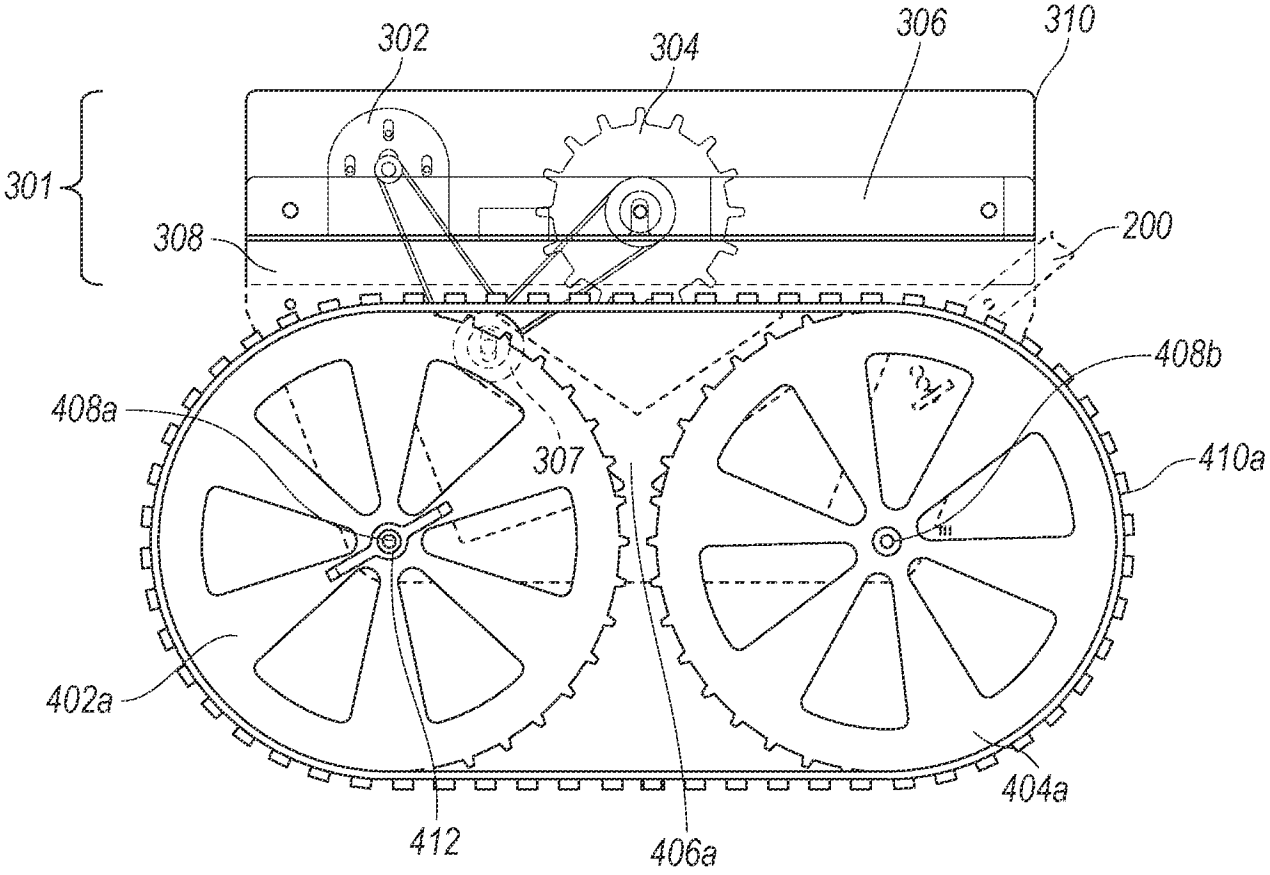
FIG. 4B is a side view of the drive assembly of FIG. 3A operably coupled to the track cutter assembly of FIG. 4A and the track cutter assembly of FIG. 4A further including a tension adjuster.

Referring to FIG. 4B, the drive unit 301 may be mounted to or integrated into the frame 406 or carried by another suitable component of the ski track setter 100. For example, the mounting frame 308 is attached to the frame 406. In some embodiments, the first frame member 406*a* is coupled to the second frame member 406*b* via attachment to the mounting frame 308. The drive unit 301 can be attached to any suitable portion of the frame 406 and extend along any front and/or rear portion of the frame 406. The drive unit 301 is located such that the drive gear 304 is operably coupled to at least one of the front wheels 402*a, b*, rear wheels 404*a, b*, front axle 408*a*, rear axle 408*b*, and tracks 410*a, b*. In the illustrated embodiment, the drive unit 301 is attached to the top portion of the frame 406 and extends from a front portion to a rear portion of the frame 406. Any suitable fastener or fastening scheme can be used to attach the components of the drive unit 301 to the frame 406.

The drive unit 301 is configured to transmit power (e.g., rotational power) to the track cutter assembly 400 by operably engaging the drive gear 304 with at least one of the front wheels 402*a, b* and rear wheels 404*a, b* during operation. For example, the motor 302 is configured to receive power from the battery 306, and the powered motor 302 transfers power to the drive gear 304 to operably engage the reduction pulley 307, which is operably coupled to at least one of the front and rear axles 408*a, b*. In turn, the reduction pulley 307 engaged with at least one of the front and rear axles 408*a, b* rotates at least one of the front wheels 402*a, b* and rear wheels 404*a, b* (e.g., a driven wheel). Rotating the driven wheel rotatably powers the other wheels via the front and rear axles 408*a, b* and/or the tracks 410*a, b*.

Referring to FIGS. 4A and 4B together, the drive unit 301 provides rotational power to the front wheel 402*a*. The reduction pulley 307 operably engages with the front wheel 402*a* via the front axle 408*a*. The front axle 408*a* rotatably couples the front wheel 402*a* to the front wheel 402*b*. For example, rotating the front wheel 402*a* in turn rotates the front wheel 402*b* via the front axle 408*a* during operation. The front wheel 402*a* is operably coupled to the rear wheel 404*a* via the track 410*a*, and the front wheel 402*b* is operably coupled to the rear wheel 404*b* via the track 410*b*. Rotating the front wheels 402*a, b* in turn rotates the rear wheels 404*a, b*, which provides rotational power to the tracks 410*a, b*. The tracks 410*a, b* include ridges. The ridges can be perpendicular to the line of forward motion and configured to grip snow as the power-assisted ski track setter is in operation.

In some embodiments, the drive unit 301 provides rotational power to at least one of the rear wheels 404*a, b*. For example, the reduction pulley 307 can be configured to operably engage with the rear wheel 404*a* via the rear axle 408*b*. The rear axle 408*b* rotatably couples the rear wheel 404*a* to the rear wheel 404*b*. For example, rotating the rear wheel 404*a* in turn rotates the rear wheel 404*b* via the rear axle 408*b*. The rear wheels 404*a, b* rotatably engage the front wheels 402*a, b* via the tracks 410*a, b*. For example, rotating the rear wheels 404*a, b* in turn rotates the front wheels 402*a, b*.

In some embodiments, the drive unit 301 can provide rotational power to at least one of the front wheels 402*a, b* and at least one of the rear wheels 404*a, b*. In some embodiments, the drive unit 301 drives one or more front wheels 402*a, b* and one or more rear wheels 404*a, b* simultaneously. In some embodiments, the drive unit 301 drives one or more front wheels 402*a, b* and one or more rear wheels 404*a, b* independently. In some embodiments, the drive unit 301 drives one or more front wheels 402*a, b* with greater power than one or more rear wheels 404*a, b*. In other embodiments, the drive unit 301 drives one or more rear wheels 404*a, b* with greater power than one or more front wheels 402*a, b*.

Referring to FIG. 4B, the track cutter assembly 400 can further include a tension adjuster 412. The tension adjuster 412 is configured to adjust the tension on the tracks 410*a, b*. The tension adjuster 412 can be positioned coaxially adjacent to the front axle 408*a* and rear wheels 404*a, b*. In the illustrated embodiment, the tension adjuster 412 is positioned coaxially adjacent to the front axle 408*a*. The tension adjuster 412 can include two screws (not illustrated). In the illustrated embodiment, the front axle 408*a* includes two tapped holes (not illustrated), each configured to receive one of the two screws. One of the two tapped holes on the front axle 408*a* is located adjacent to the first frame member 406*a* (FIG. 4A), and the second one of the two tapped holes is located adjacent to the second frame member 406*b* (FIG. 4A). The front axle 408*a* can be mounted in a slot of the frame 406 configured to allow the front axle 408*a* to move in a forward and backward direction. Turning the tension adjuster 412 turns the screws (e.g., clockwise), which in turn pulls the front axle 408*a* forward and tightens the tracks 410*a, b*. Likewise, turning the tension adjuster 412 in an opposite direction (e.g., counterclockwise) in turn loosens the tracks 410*a, b*. Although FIG. 4B illustrates the tension adjuster 412 positioned coaxially adjacent to the front axle 408*a*, the tension adjuster 412 can be positioned coaxially adjacent to the rear axle 408*b*, and the rear axle 408*b* can be configured to receive the screws such that turning the tension adjuster 412 pulls the rear axle 408*b* backward to tighten the tracks 410*a, b*.

Figure 5A:
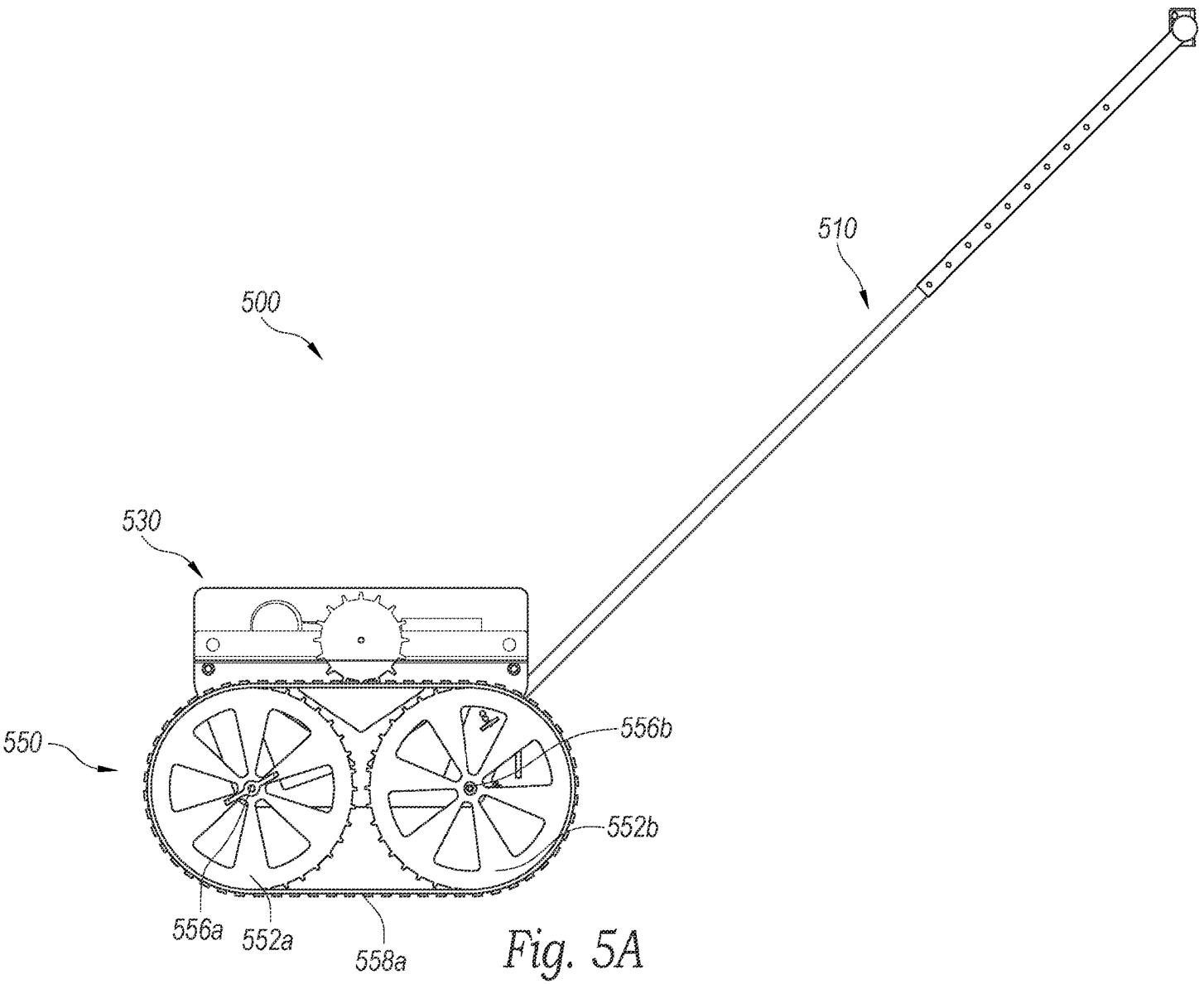
FIG. 5A is a left side view of a power-assisted ski track setter configured in accordance with another embodiment of the present technology.
Figure 5B:
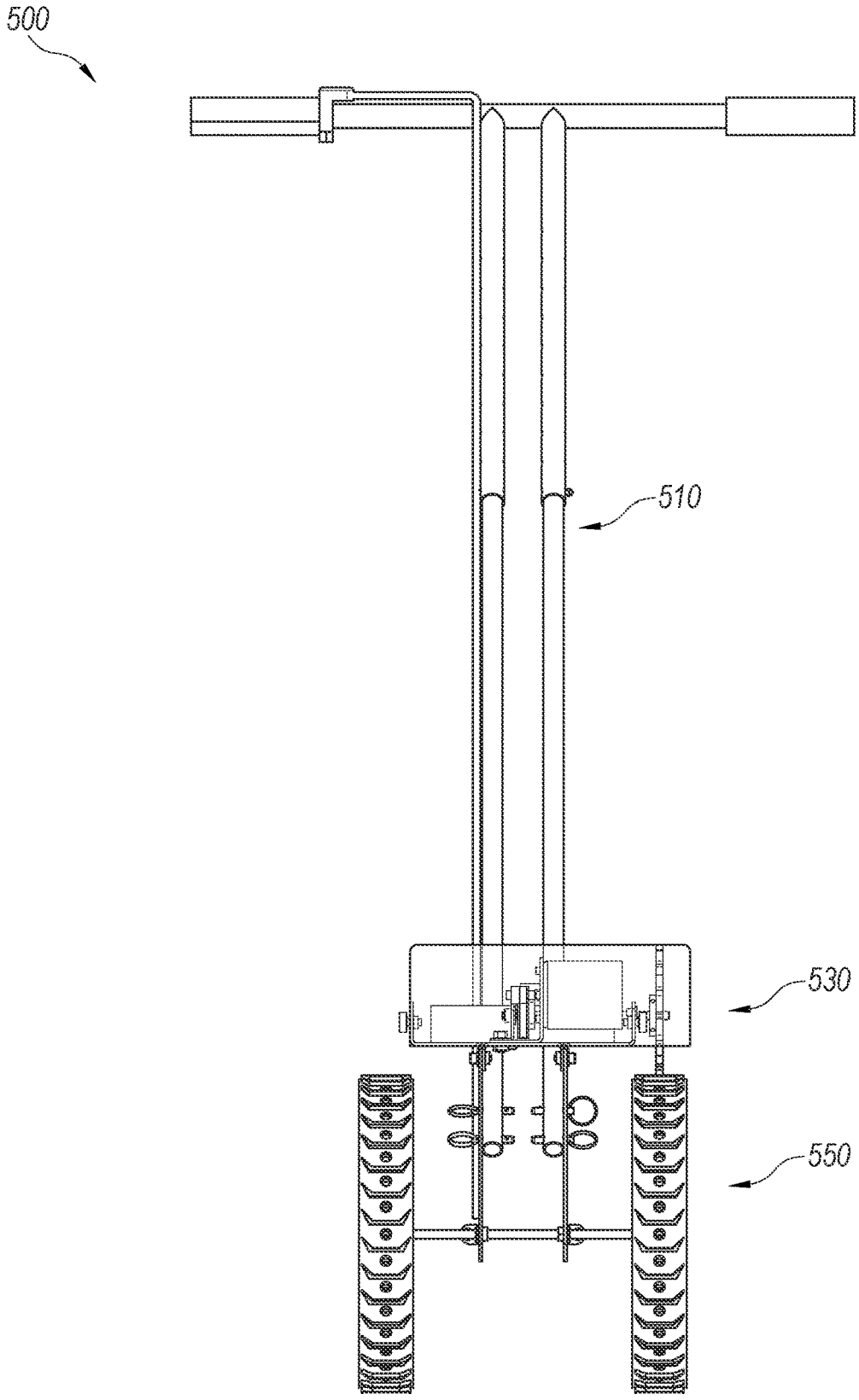
FIG. 5B is a front view of the power-assisted ski track setter of FIG. 5A.

FIG. 5A is a left side view and FIG. 5B is a front view of a power-assisted ski track setter 500 ("ski track setter 500") configured in accordance with further embodiments of the present technology. Referring to FIGS. 5A and 5B together, the ski track setter 500 includes a user control assembly 510, a drive assembly 530, and a track cutter assembly 550. The user control assembly 510 and track cutter assembly 550 can be generally similar to or the same as the user control assembly 200 and track cutter assembly 400, respectively, as described with respect to FIGS. 1A-4B.

Figure 5C:
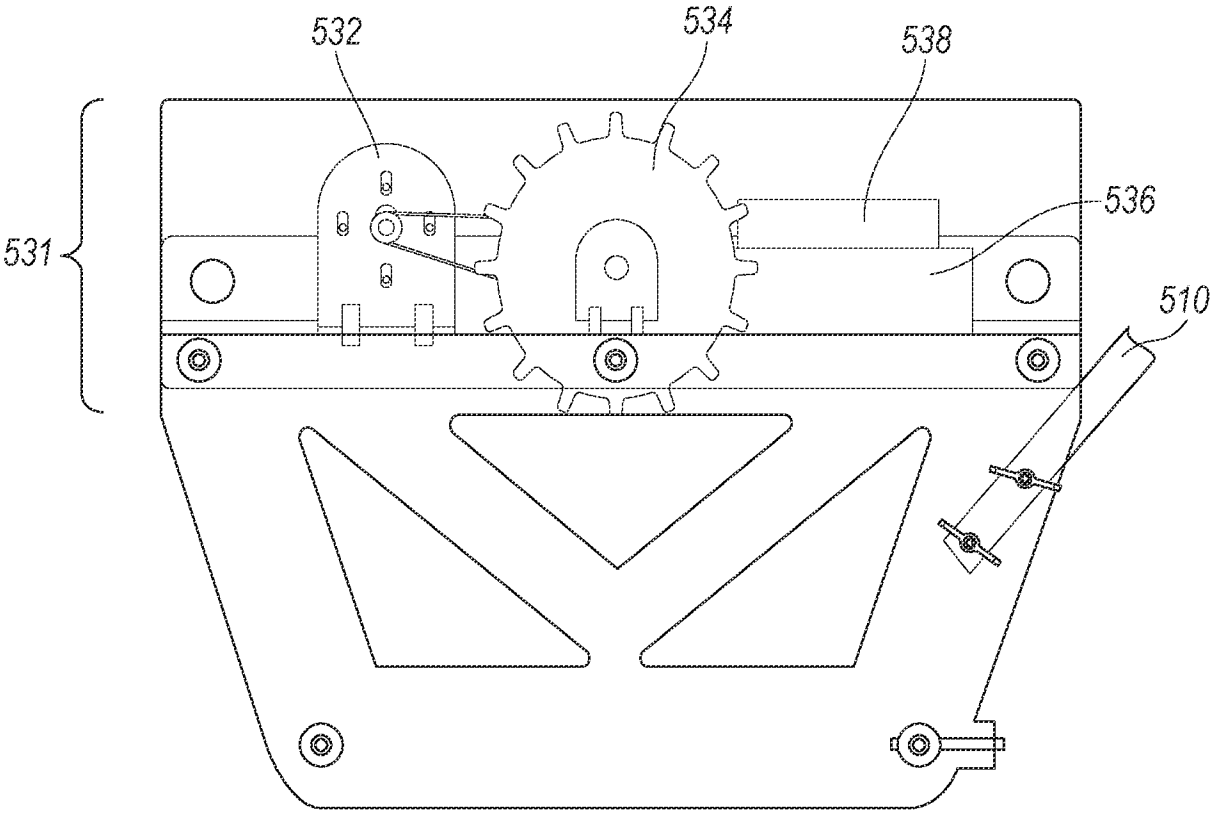
FIG. 5C is a side view of a drive assembly of the power-assisted ski track setter of FIG. 5A.

The drive assembly 530 can be generally similar to the drive assembly 300 as described with respect to FIGS. 1A-4B, except that the drive assembly 530 includes a drive unit 531 with several components/features different from the drive unit 301 described above. FIG. 5C, for example, is a side view of the drive assembly 530. The drive unit 531 includes a motor 532, a drive sprocket 534, a battery 536, and an electronic speed controller 538. The motor 532 can be generally similar to or the same as the motor 302 as described with respect to FIGS. 1A-4B. The battery 536 can be generally similar to or the same as the battery 306 as described with respect to FIGS. 1A-4B. The electronic speed controller 538 can be generally similar to or the same as the electronic speed controller 338 as described with respect to FIGS. 3A and 3B. The drive sprocket 534 can be formed from nylon, stainless steel, aluminum (e.g., 2024, 7075, etc.), Polyether ether ketone (PEEK), carbon steel, and/or other suitable materials. Depending on the material, the gears can receive various heat treatments and/or include hardened surface coatings (carbon, titanium nitride, anodizing, TEFLON® infusion, etc.), and can be formed by machining, forging, die casting, metal injection molding, etc. Referring back to FIG. 5B, although the ski track setter 500 includes the drive assembly 530 mounted over a right portion of the track cutter assembly 550, in other embodiments the drive assembly 530 can extend over a right and left portion of the track cutter assembly 550.

Figure 5D:
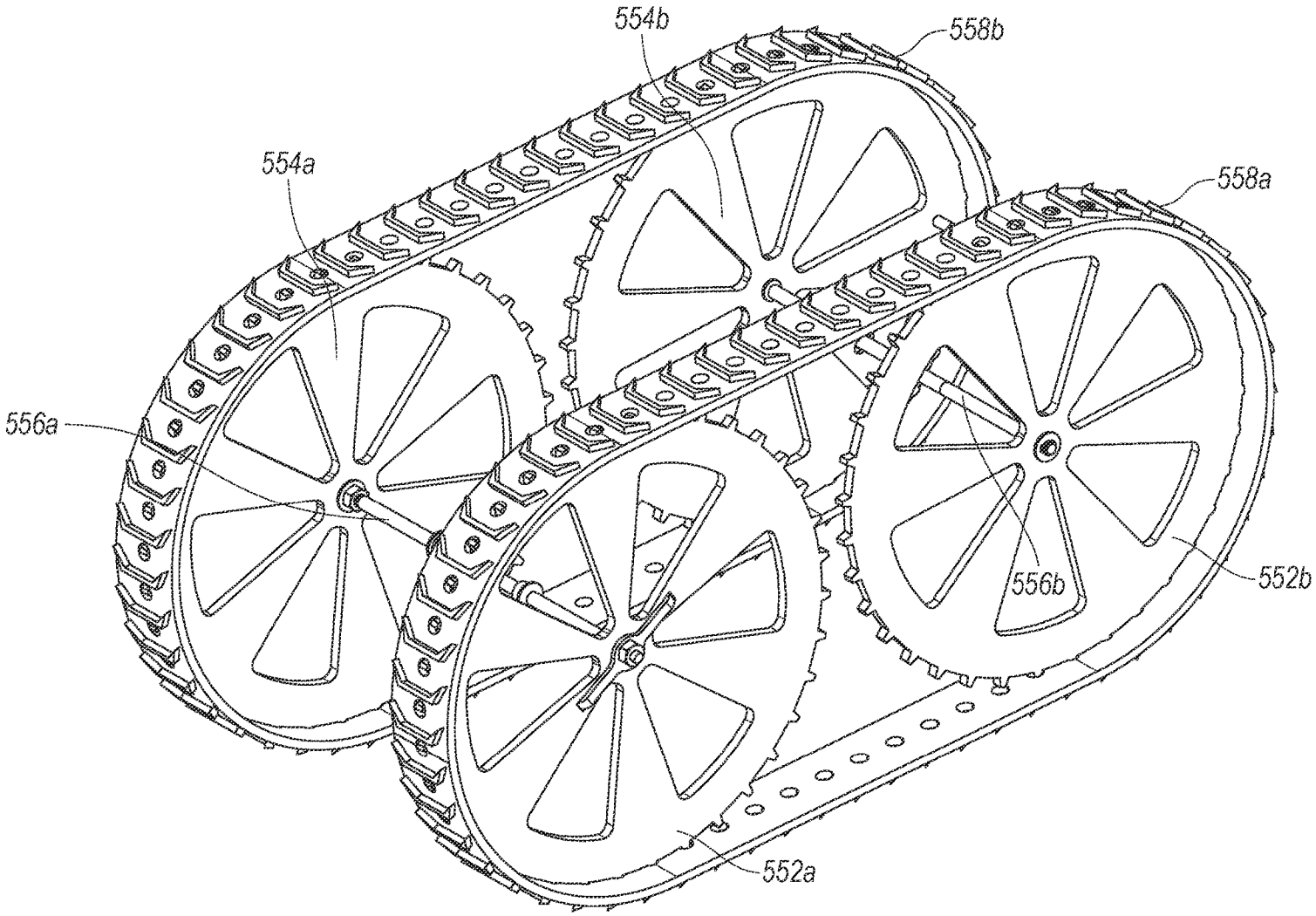
FIG. 5D is a front isometric view of a track cutter assembly of the power-assisted ski track setter of FIG. 5A.

FIG. 5D is a front isometric view of the track cutter assembly 550. The track cutter assembly 550 includes first wheels 552*a, b*, second wheels 554*a, b*, a front axle 556*a* which operably couples the first wheel 552*a* with the second wheel 554*a*, a rear axle 556*b* which operably couples the first wheel 552*b* with the second wheel 554*b*, a first track 558*a* which encircles the first wheels 552*a, b*, and a second track 558*b* which encircles the second wheels 554*a, b*.

Figure 5E:
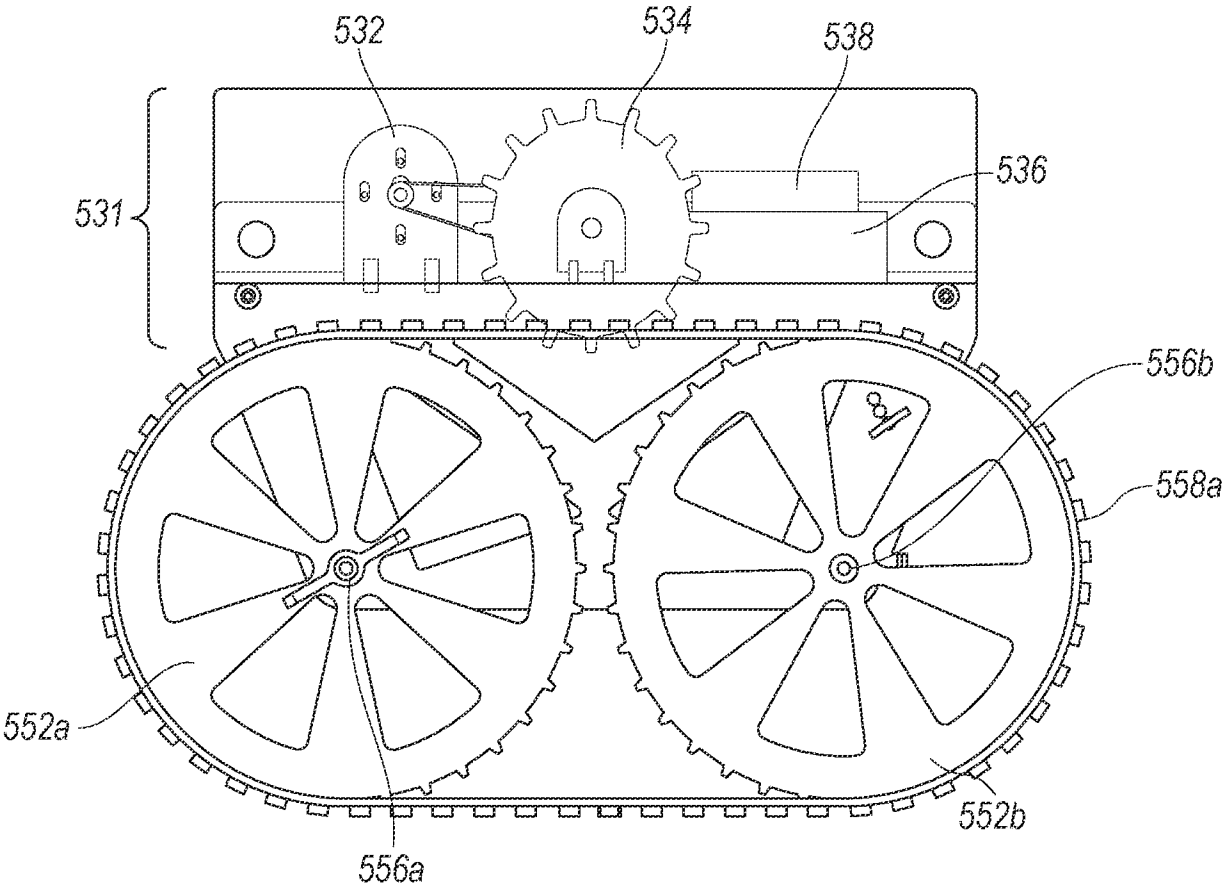
FIG. 5E is a side view of the drive assembly of FIG. 5C operably coupled to the track cutter assembly of FIG. 5D.

FIG. 5E is a side view of the drive assembly 530 operably coupled to the track cutter assembly 550. Similar to operation of the ski track setter 100 described above with reference to FIGS. 1A-4B, the battery 536 of the ski track setter 500 is configured to transmit power to the motor 532, which is configured to transfer power to the drive sprocket 534. In turn, the powered drive sprocket 534 rotatably engages the track cutter assembly 550 during operation. In some embodiments, the drive unit 531 is configured to transmit power to the track cutter assembly 550 by operably engaging the drive sprocket 534 with at least one of the first track 558*a* and second track 558*b* during operation. For example, the motor 532 is configured to receive power from the battery 536. The powered motor 532 transfers the power to the drive sprocket 534, which is operably coupled to at least one of the first track 558*a* and the second track 558*b*. Rotating the first track 558*a* and/or the second track 558*b* rotatably powers the respective first wheels 552*a, b* and/or second wheels 554*a, b*.

In some embodiments, the drive sprocket 534 is configured to operably engage with the first track 558*a*. The drive sprocket 534, for example, includes teeth that mesh with ridges and/or holes on the first track 558*a*. The first track 558*a* is rotatably coupled to the first wheels 552*a, b*, which are operably coupled to the second wheels 554*a, b* via axles 556*a, b*. Rotating the drive sprocket 534 rotates the first track 558*a*, which in turn rotates the first wheels 552*a, b*. The first wheels 552*a, b* rotate the second wheels 554*a, b* via the axles 556*a, b*, which in turn rotates the second track 558*b*. Although FIGS. 5B and 5E illustrate the drive sprocket 534 operably engaging with the first track 558*a* to provide rotational power to the first wheels 552*a, b*, the drive sprocket 534 can operably engage with the second track 558*b* to provide rotational power to the second wheels 554*a, b*. Although FIGS. 5B and 5E illustrate the drive unit 531 including one drive sprocket, the drive unit 531 can include one or more drive sprockets. For example, the drive unit 531 can include two drive sprockets, such that the motor provides rotational power to both drive sprockets and each drive sprocket operably engages with each track.

In some embodiments, the drive unit 531 can drive one or both tracks 556*a, b* simultaneously. In some embodiments, the drive unit 531 drives one or both tracks 556*a, b* independently. In some embodiments, the drive unit 531 drives the first track 558*a* with greater power than the second track 558*b*. In other embodiments, the drive unit 531 drives the second track 558*b* with greater power than the first track 558*a*.

The drive sprocket 534 can be operably coupled to at least one of two right wheels 552*a, b* and left wheels 554*a, b* of the track cutter assembly 550. For example, the drive sprocket 543 can be operably coupled to the right wheel 552*a*, the right wheel 552*b*, or both right wheels 552*a, b*. The right wheels 552*a, b* are operably coupled to the left wheels 554*a, b* via axles 556*a, b*. For example, the right wheel 552*a* is operably coupled to the left wheel 554*a* via the axle 556*a*, and the right wheel 552*b* is operably coupled to the left wheel 554*b* via the axle 556*b*. In operation, rotating the right wheels 552*a, b* by the drive sprocket 534 rotates the corresponding left wheels 554*a, b*.

Figure 6A:
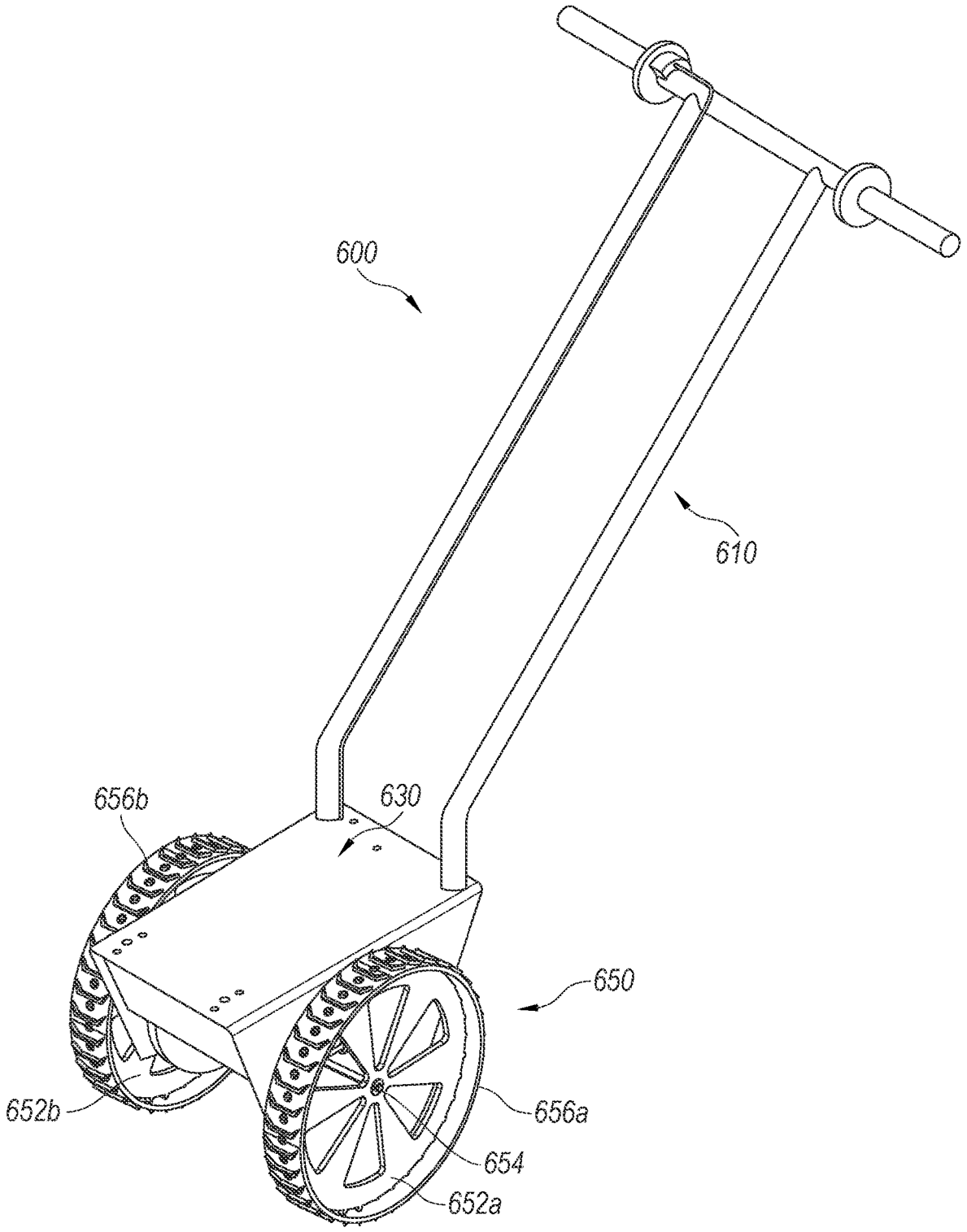
FIG. 6A is a top front left isometric view of a power-assisted ski track setter configured in accordance with still another embodiment of the present technology.
Figure 6B:
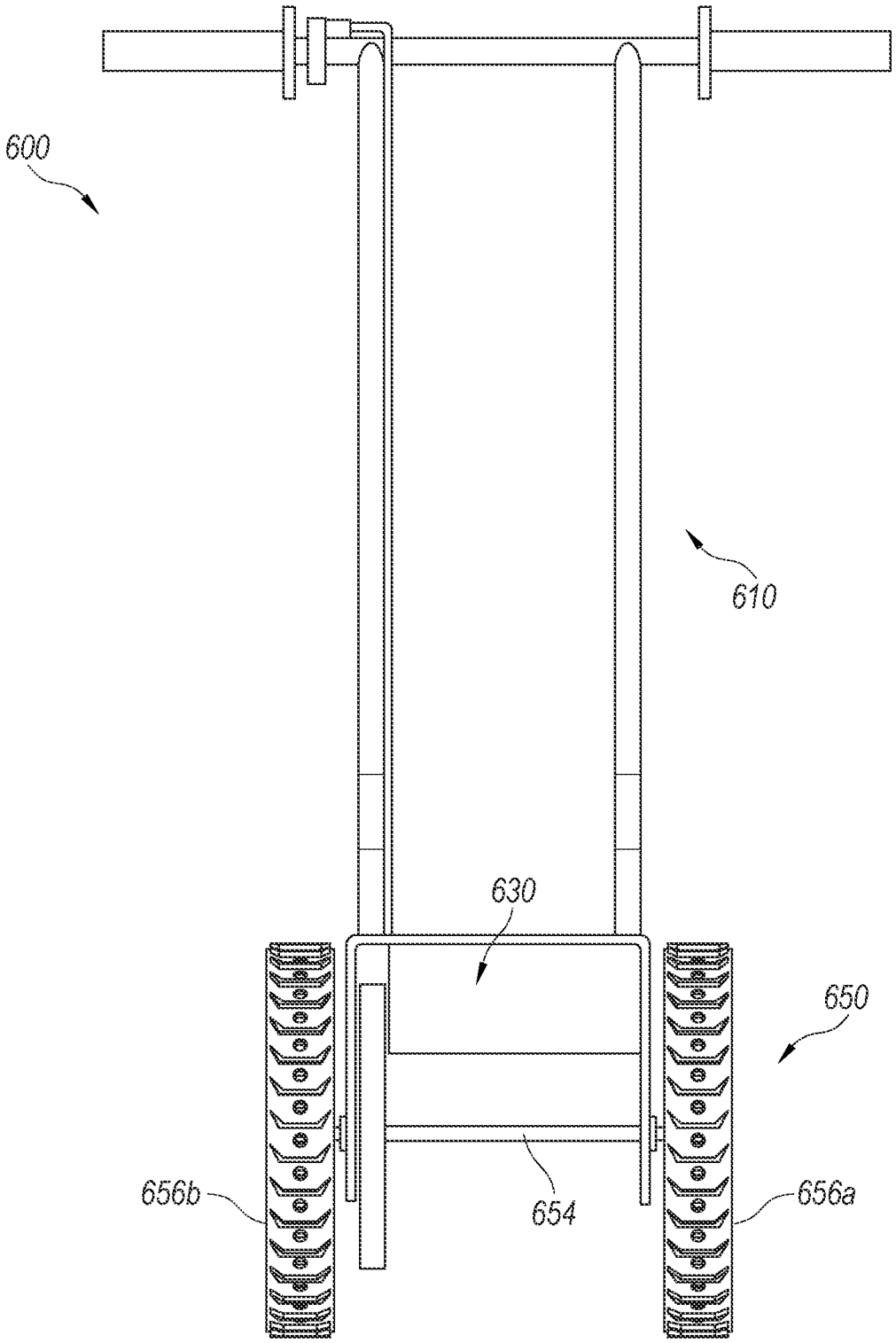
FIG. 6B is a front view of the power-assisted ski track setter of FIG. 6A.
Figure 6C:
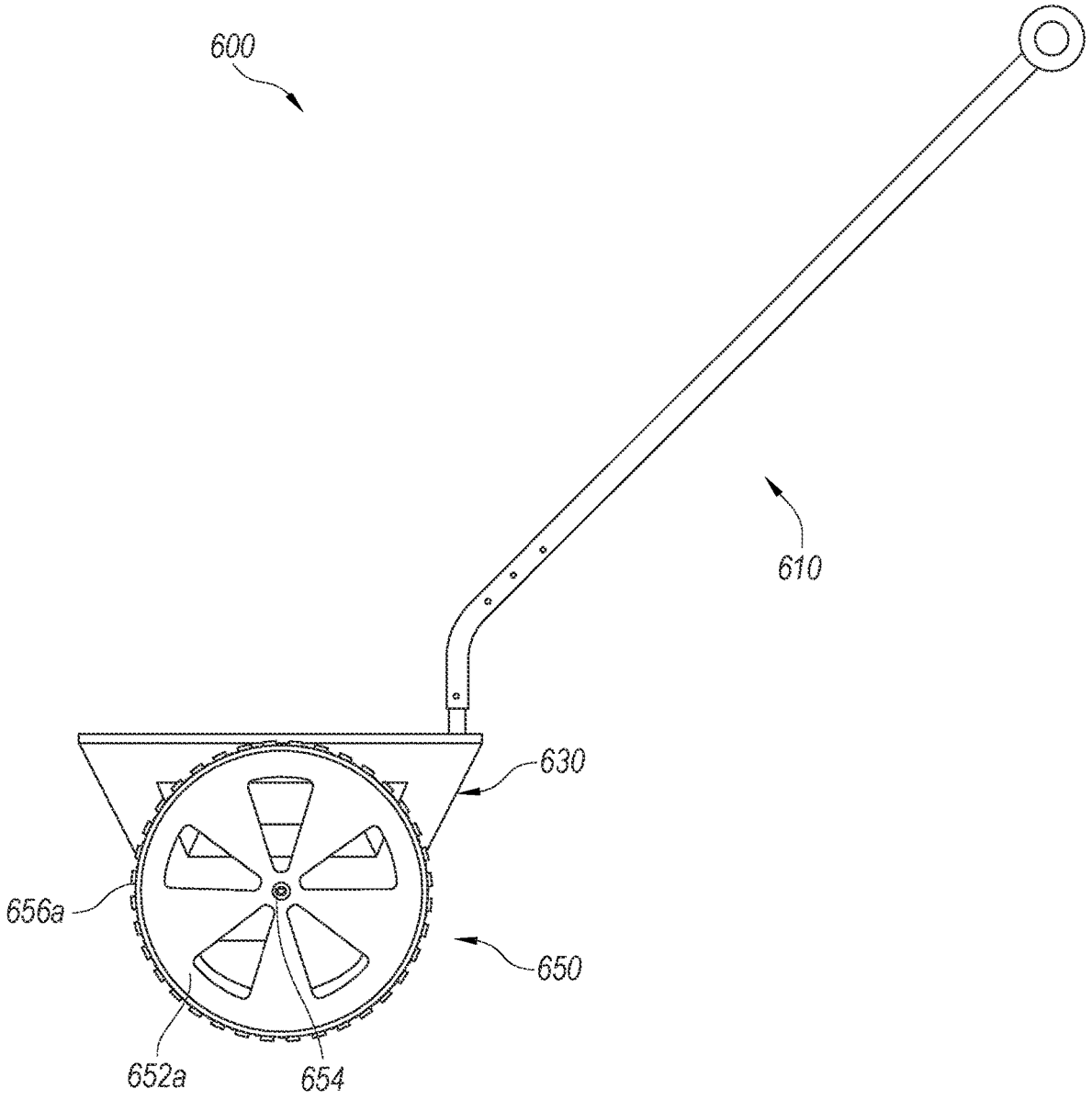
FIG. 6C is a side view of the power-assisted ski track setter of FIG. 6A.
Figure 6D:
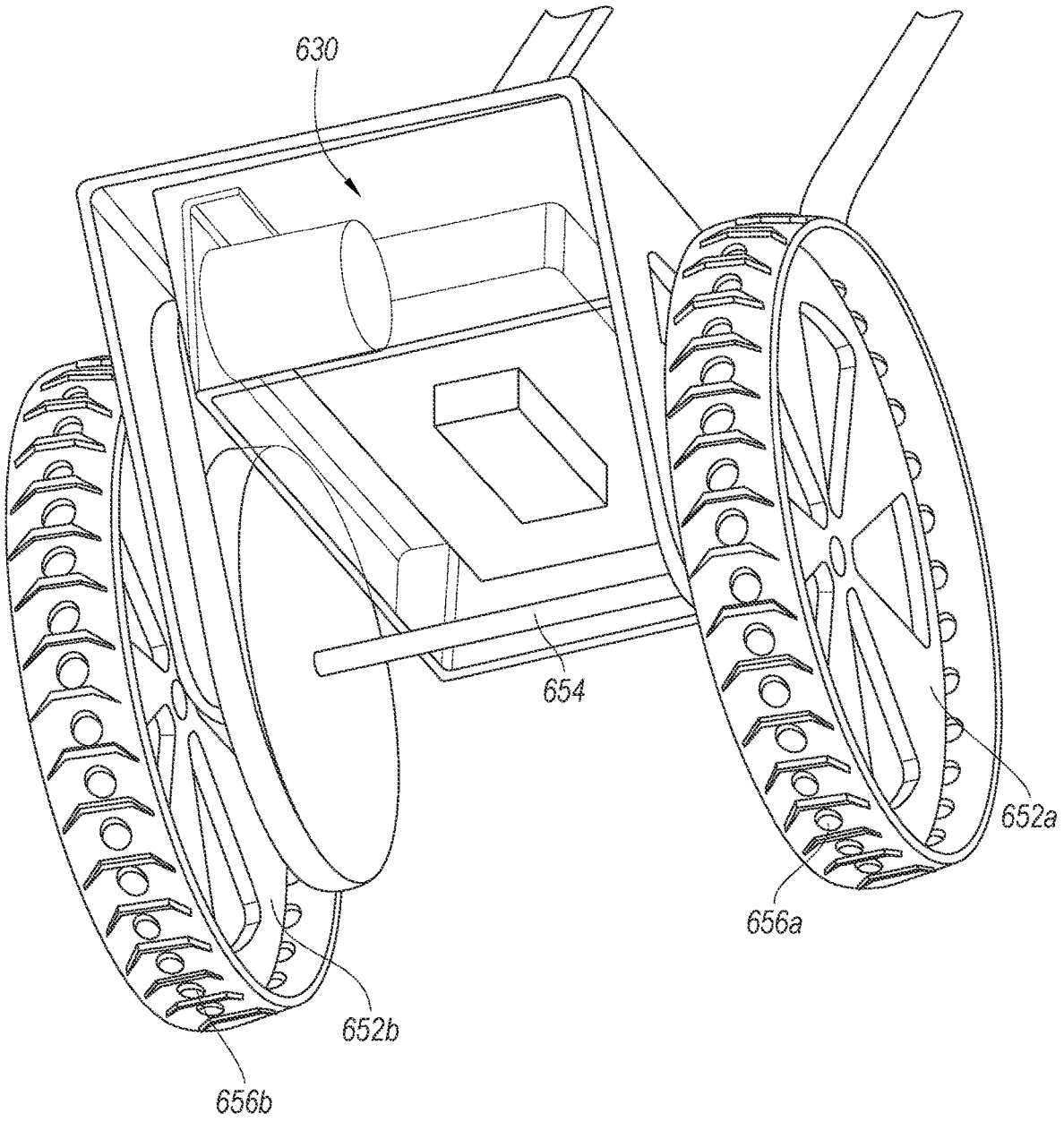
FIG. 6D is a partial bottom front isometric view of a drive assembly and a track cutter assembly of the power-assisted ski track setter of FIG. 6A.

FIG. 6A is a top front left isometric view, FIG. 6B is a front view, FIG. 6C is a side view, and FIG. 6D is a partial bottom front isometric view of a power-assisted ski track setter ("ski track setter 600") configured in accordance with still another embodiment of the present technology. Referring to FIGS. 6A-D together, the ski track setter 600 comprises a user control assembly 610, a drive assembly 630, and a track cutter assembly 650. The user control assembly 610 can be generally similar to or the same as the user control assembly 200 as described with respect to FIGS. 1A-4B, and the drive assembly 630 can be generally similar to or the same as the drive assemblies 300 and 530 as described with respect to FIGS. 1A-4B and FIGS. 5A-E, respectively. Further, it will be appreciated that although FIGS. 6A-D illustrate the drive assembly 630 mounted laterally adjacent to the track cutter assembly 650, in other embodiments the drive assembly 630 can be mounted at any suitable position adjacent to the track cutter assembly 650. In some embodiments, for example, the drive assembly 630 can be mounted above the track cutter assembly 650.

Referring to FIGS. 6A-D together, the track cutter assembly 650 can be generally similar to the track cutter assembly 300 as described with respect to FIGS. 1A-4B, except that the track cutter assembly 650 includes a first wheel 652*a* operably coupled to a second wheel 652*b* via an axle 654. The track cutter assembly 650 further includes a first track 656*a* encircling the first wheel 652*a* and a second track 656*b* encircling the second wheel 652*b*. The tracks 656*a, b* can be composed of rubber or other suitable track materials. Each wheel 652*a, b* can have a diameter, for example, in the range of 8 to 20 inches, or other suitable diameters. In one particular embodiment, for example, each wheel 652*a, b* has a diameter of 10 inches. In other embodiments, however, the wheels 652*a, b* can have different diameters (e.g., less than 8 inches, greater than 20 inches). Each wheel 652*a, b* can have a width, for example, of 1, 2, 3, 4, 5, 6 inches, or any suitable width. In some embodiments, the drive assembly 630 is generally similar to the drive assembly 300 as described with respect to FIGS. 1A-4B and includes a reduction pulley (not illustrated) to operably engage the first wheel 652*a* and/or the second wheel 652*b*. For example, the reduction pulley operably engages the first wheel 652*a*, which in turn rotatably engages the second wheel 652*b* via the axle 654 during operation. In operation, engaging the first wheel 652*a* rotatably engages the first track 656*a*, and engaging the second wheel 652*b* rotatably engages the second track 656*b*. In other embodiments, the drive assembly 630 is generally similar to the drive assembly 530 as described with respect to FIGS. 5A-E and includes a drive sprocket (not illustrated) to operably engage the first track 656*a* and/or the second track 656*b*. For example, the drive sprocket operably engages the first track 656*a*, which in turn rotatably engages the first wheel 652*a* during operation. In turn, the first wheel rotatably engages the second wheel 652*b* via the axle 654 and the second track 656*b* during operation.

Figure 7A:
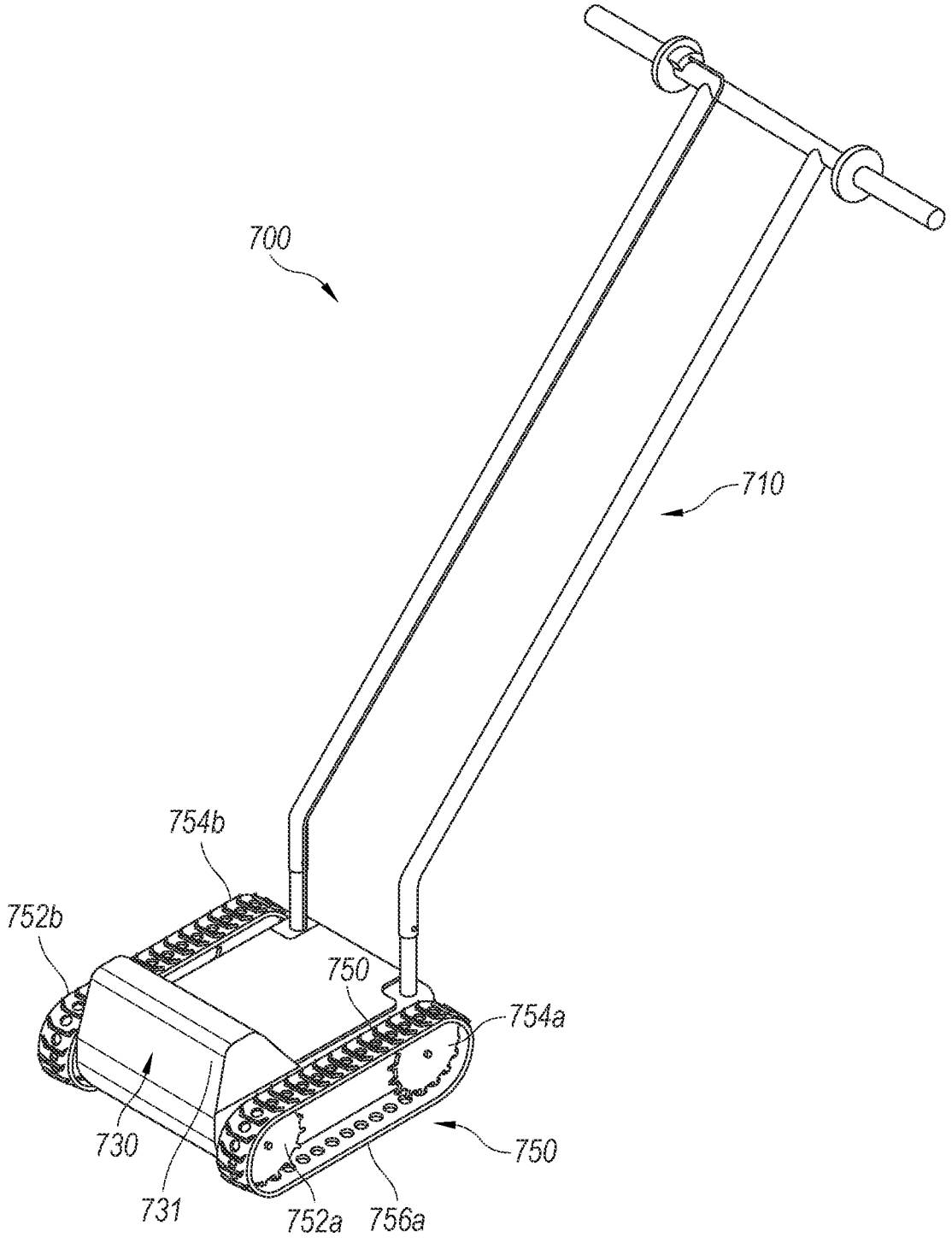
FIG. 7A is a top front left isometric view of a power-assisted ski track setter configured in accordance with a further embodiment of the present technology.
Figure 7B:
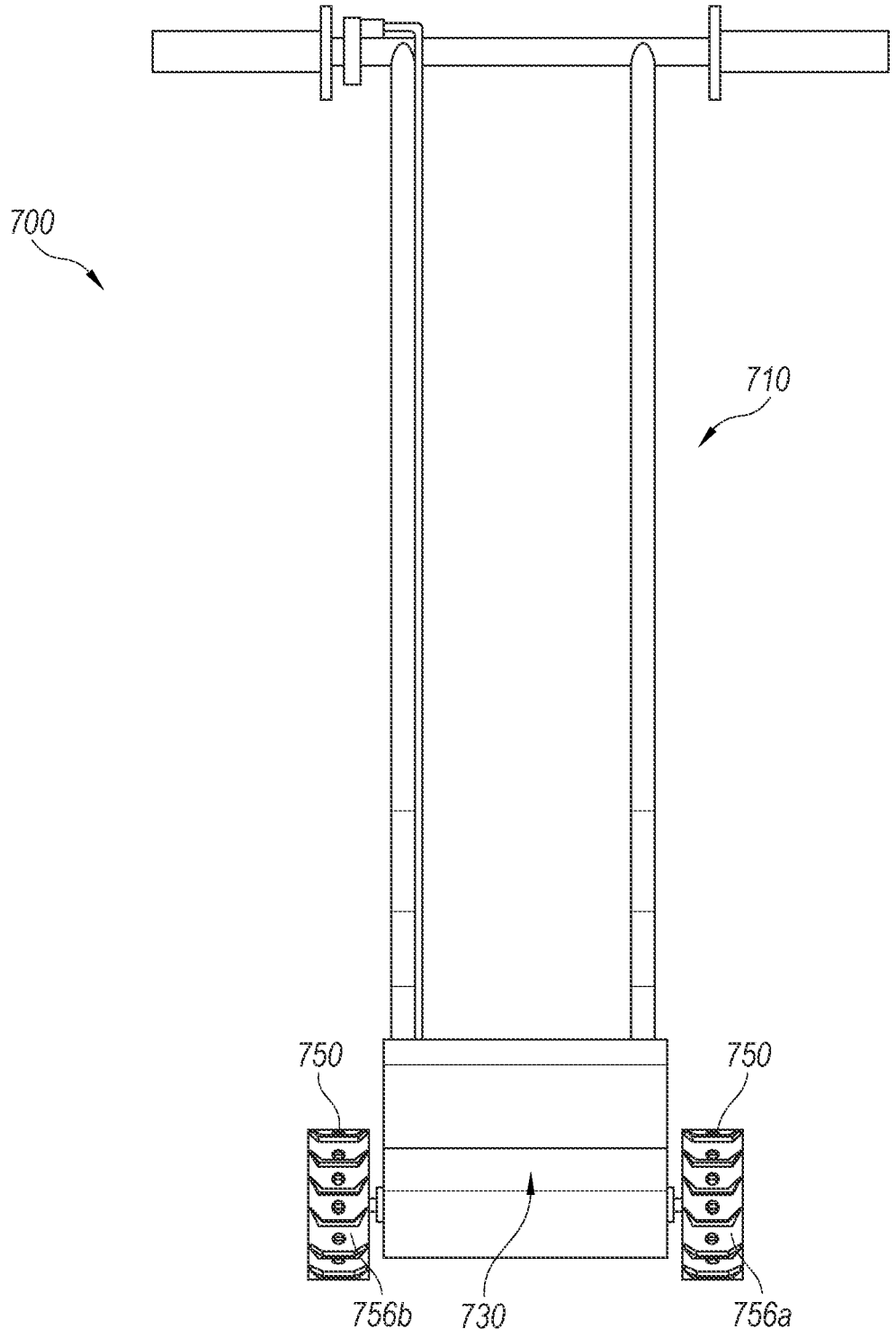
FIG. 7B is a front view of the power-assisted ski track setter of FIG. 7A.
Figure 7C:
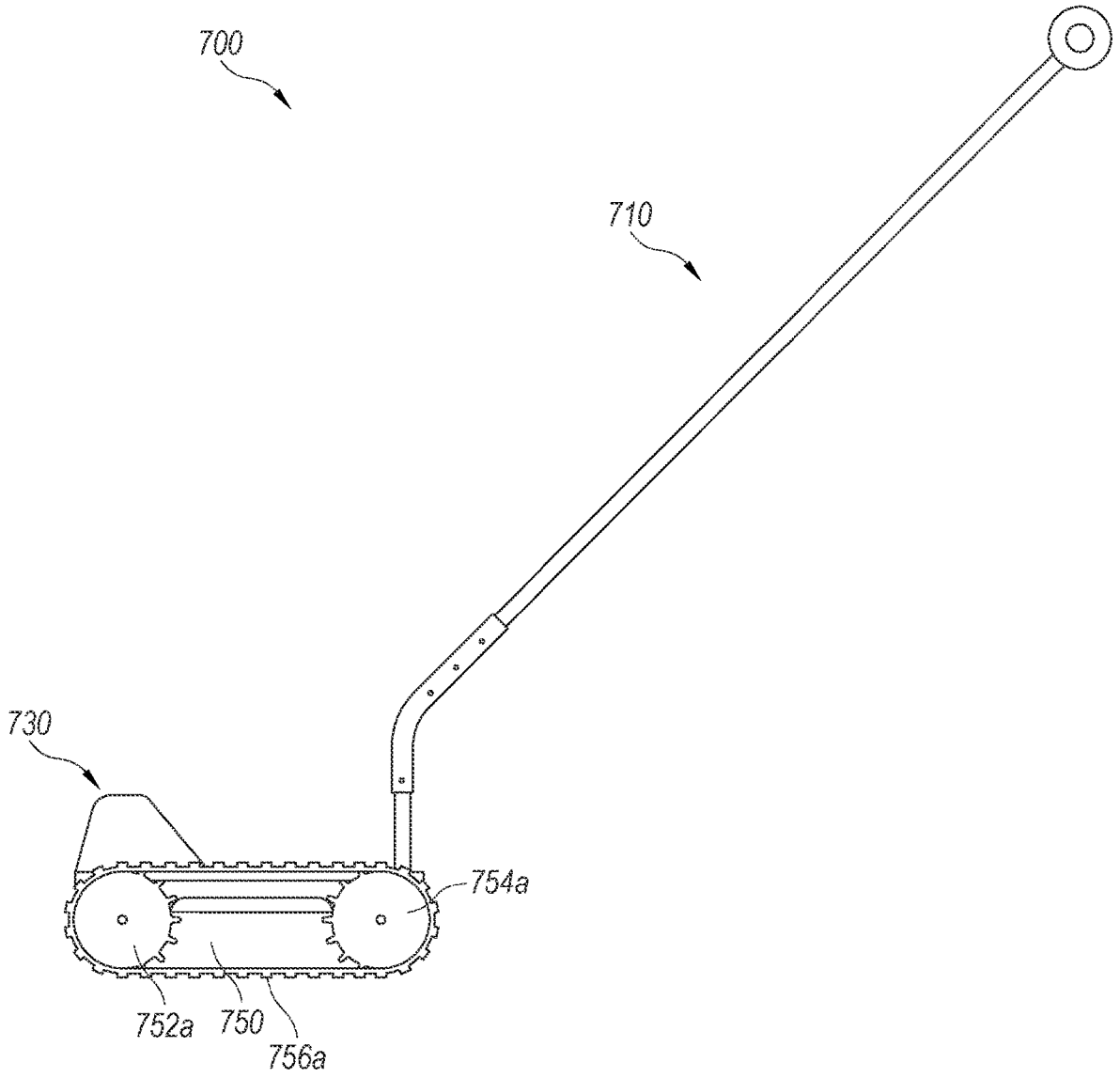
FIG. 7C is a side view of the power-assisted ski track setter of FIG. 7A.
Figure 7D:
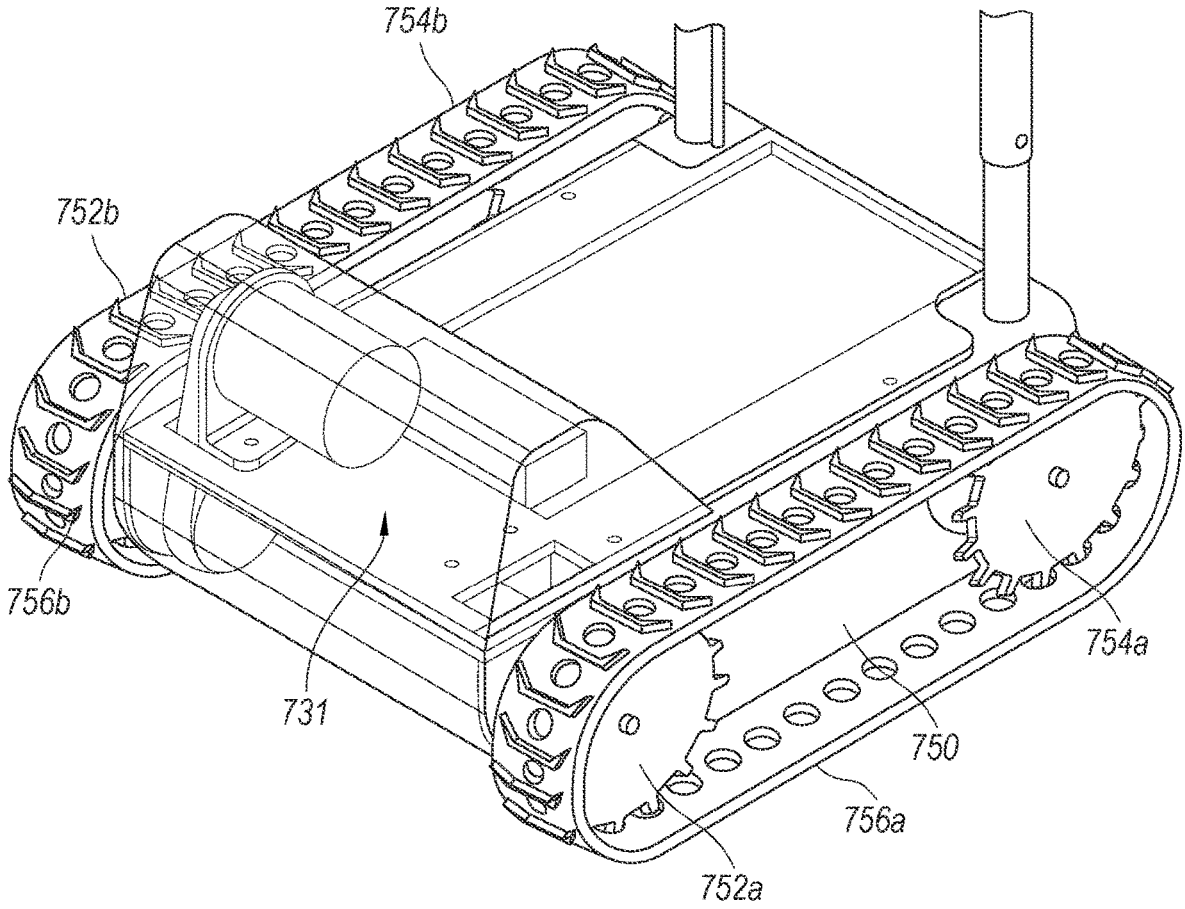
FIG. 7D is a partial top left front isometric view of a drive assembly and a track cutter assembly of the power-assisted ski track setter of FIG. 7A.

FIG. 7A is a top front left isometric view, FIG. 7B is a front view, FIG. 7C is a side view, and FIG. 7D is a partial top left front isometric view of a power-assisted ski track setter ("ski track setter 700") configured in accordance with another embodiment of the present technology. Referring to FIGS. 7A-D together, the ski track setter 700 includes a user control assembly 710, a drive assembly 730, and a track cutter assembly 750. The user control assembly 710 can be generally similar to or the same as the user control assembly 200 as described with respect to FIGS. 1A-4B. The drive assembly 730 can be generally similar to or the same as the drive assembly 300 as described with respect to FIGS. 1A-4B or the drive assembly 530 as described with respect to FIGS. 5A-E, except that the drive assembly 730 of the ski track setter 700 includes a drive unit 731 mounted adjacent to the front portion of the track cutter assembly 750. For purposes of illustration, a portion of a housing of the drive unit 731 in FIG. 7D is shown transparently. Although FIGS. 7A-D illustrate the drive assembly 730 mounted laterally adjacent to the track cutter assembly 750, the drive assembly 730 can be mounted at any suitable position adjacent to the track cutter assembly 750. For example, the drive assembly 730 can be mounted above the track cutter assembly 750.

Referring to FIGS. 7A-D, the track cutter assembly 750 can be generally similar to the track cutter assemblies 400 and 550 as described with respect to FIGS. 1A-4B and FIGS. 5A-E, respectively, except that the track cutter assembly 750 includes wheels 752*a, b* and 754*a, b* having a diameter smaller than that of the wheels 402*a, b*, 404*a, b*, 552*a, b*, and 554*a, b* of track cutter assemblies 400 and 550. For example, the diameter of the wheels 752*a, b* and 754*a, b* may be in the range of 3 to 20 inches, or other suitable diameters. In one particular embodiment, for example, the diameter of the wheels 752*a, b* and 754*a, b* is 4 inches. One expected advantage of the ski track setter 700 including smaller wheels is that the ski track setter 700 may be suitable for conditions with compact snow. In other embodiments, however, the wheels 752*a, b* and 754*a, b* of the ski track setter 700 may have different diameters (e.g., less than 3 inches, greater than 20 inches).

Figure 8:
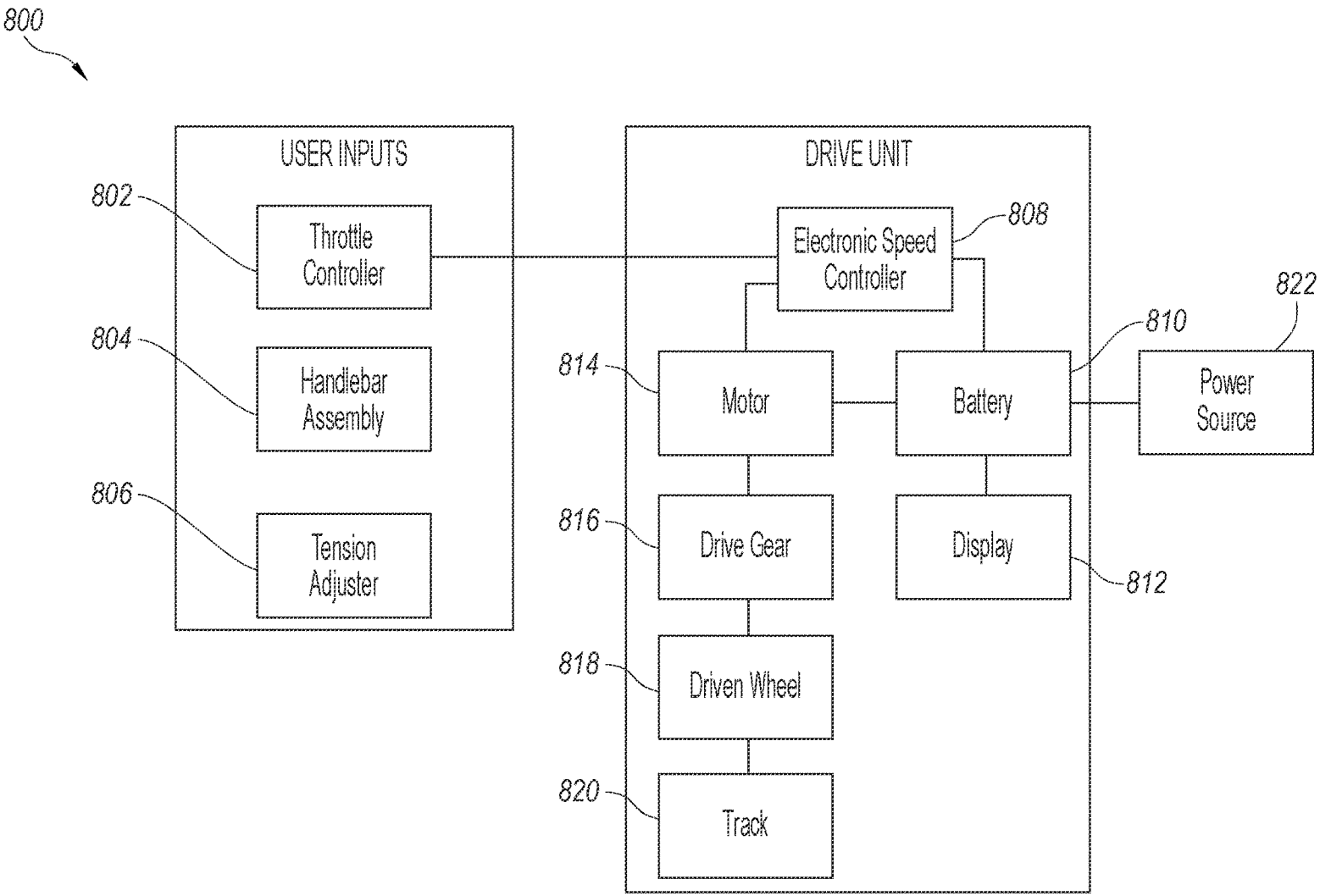
FIG. 8 is a schematic diagram of a power-assisted ski track setter system configured in accordance with embodiments of the present technology.

FIG. 8 is a schematic diagram of a power-assisted ski track setter system ("system 800") configured in accordance with embodiments of the present technology. The user inputs include a throttle controller 802, a handlebar assembly 804, and a tension adjuster 806. The throttle controller 802 is in communication with an electronic speed controller 808 by any suitable connection, such as a push-pull cable, electrical wire, or wireless signal. The electronic speed controller 808 is in communication through an electrical wire to a battery 810. The battery 810 may be optionally connected to a display 812 configured to display information for the user, such as battery charge percentage. In some embodiments, the electronic speed controller 808 may be collocated with a motor 814. When the electronic speed controller 808 receives a signal from the throttle controller 802, the electronic speed controller 808 supplies power to the motor 814 of a drive unit system, which transmits rotational power through a drive gear 816 and accordingly to one or more driven wheels 818 and one or more tracks 820 encircling the one or more driven wheels 818. Although the battery 810 is shown in direct electrical communication with the motor 814, in other embodiments, the electrical power from the battery 810 can travel first to the electronic speed controller 808 and then to the motor 814 in electrical communication with the electronic speed controller 808. The drive unit system may include a charge port configured to receive electrical power from, e.g., an external power source, such as an AC/DC power source 822, and supply electrical power to charge the battery 810. During operation, the user inputs a desired speed, torque, and/or power-assist level via the throttle controller 802, which sends a signal to the speed controller 808. Based on the received signal, the electronic speed controller 808 controls an amount of voltage provided to the motor 814 from the battery 810 to modulate speed, torque, or total power. Alternatively, the speed controller 808 directs power from the battery 810 through the speed controller 808 and to the motor 814. The motor 814 rotationally drives the drive gear 816, which meshes with the one or more driven wheels 818 and/or the one or more tracks 820. In some embodiments, the throttle controller 802 can include a button that the user can push down, and the user can stop the operation of the system 800 by releasing the button.

CONCLUSION

The above Detailed Description of embodiments of the technology is not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, any of the features of the ski track setters described herein may be combined with any of the features of the other ski track setters described herein and vice versa. Moreover, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions associated with ski track setters have not been shown or described in detail to avoid unnecessarily obscuring the description of the embodiments of the technology. Where the context permits, singular or plural terms may also include the plural or singular term, respectively.

Unless the context clearly requires otherwise, throughout the description and the examples, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. As used herein, the phrase "and/or" as in "A and/or B" refers to A alone, B alone, and A and B. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A power-assisted ski track setter system, comprising:

a user control assembly comprising a handlebar assembly configured to control the direction of the ski track setter;

a track cutter assembly comprising:

a frame, one or more first wheels positioned at a first side of the frame, one or more second wheels positioned at a second side of the frame, a first track engaged with the one or more first wheels, a second track engaged with the one or more second wheels, and a tension adjuster positioned coaxially adjacent to the one or more first wheels or the one or more second wheels, a drive assembly configured to be mounted adjacent to the frame, the drive assembly comprising:

a motor configured to transmit power to the track cutter assembly, a battery electrically connected to the motor, and a drive gear operably coupled to the motor, wherein, during operation, the drive assembly is configured to operably engage the track cutter assembly and transmit power to the track cutter assembly to drive the ski track setter.

2. The power-assisted ski track setter system of claim 1 wherein the drive assembly is configured to be mounted vertically above the frame.

3. The power-assisted ski track setter system of claim 1 wherein the drive assembly is configured to be mounted laterally adjacent to the frame.

4. The power-assisted ski track setter system of claim 1 wherein the one or more first wheels includes a first front wheel and a first rear wheel and the one or more second wheels includes a second front wheel and a second rear wheel.

5. The power-assisted ski track setter system of claim 1 wherein the first track and the second track comprise a rubber material.

6. The power-assisted ski track setter system of claim 1 wherein the one or more first wheels includes a single first wheel and the one or more second wheels includes a single second wheel.

7. The power-assisted ski track setter system of claim 1 wherein the drive assembly further includes a reduction pulley configured to operably engage an axle operably coupled to the one or more first wheels and the one or more second wheels.

8. The power-assisted ski track setter system of claim 1 wherein the drive gear is configured to transmit power from the motor to the reduction pulley.

9. The power-assisted ski track setter system of claim 1 wherein the drive gear is a drive sprocket.

10. The power-assisted ski track setter system of claim 9 wherein the drive sprocket is configured to rotatably power the first track and/or the second track.

11. The power-assisted ski track setter system of claim 9 wherein the drive sprocket is configured to rotatably power the first track and the rotatably powered first track provides rotational power to the second track.

12. The power-assisted ski track setter system of claim 9 wherein the first track and the second track include ridges and/or holes and the drive sprocket includes teeth that mesh with the ridges and/or holes of the first track and the second track.

13. The power-assisted ski track setter system of claim 1, further comprising a throttle controller in electrical communication with the battery and the motor and configured to receive an input signal from a user and variably direct electrical power to the motor.

14. The power-assisted ski track setter system of claim 13, further comprising an electronic speed controller in electrical communication with the throttle controller.

15. The power-assisted ski track setter system of claim 1 wherein the one or more first wheels and the one or more second wheels are driven simultaneously.

16. The power-assisted ski track setter system of claim 1 wherein the one or more first wheels and the one or more second wheels are driven independently.

17. A power-assisted ski track setter, comprising:

a first frame member;

a second frame member positioned laterally adjacent to the first frame member;

a track cutting device comprising:

a first front wheel operably coupled to a first rear wheel via a first track, wherein the first front wheel and the first rear wheel are carried by the first frame member, a second front wheel operably coupled to a second rear wheel via a second track, wherein the second front wheel and the second rear wheel are carried by the second frame member, and a tension adjuster positioned coaxially adjacent to the first front wheel, the first rear wheel, the second front wheel, or the second rear wheel;

a drive unit operably mounted to and carried by at least one of the first frame member and the second frame member, wherein the drive unit comprises:

an electric motor, a battery in electrical communication to the electric motor, and a drive gear operably coupled to the electric motor;

a throttle controller in electrical communication with the battery and the electric motor and configured to receive an input signal from a user and variably direct electrical power to the electric motor; and a handlebar assembly configured to control the direction of the power-assisted ski track setter.

18. The power-assisted ski track setter of claim 17, further comprising a portable power source configured to at least partially recharge the battery.

19. The power-assisted ski track setter of claim 17 wherein, during operation, the drive unit is configured to operably engage the track cutting device to drive the first and second tracks.

* * * * *